US007133629B2

(12) United States Patent
Kita

(10) Patent No.: US 7,133,629 B2
(45) Date of Patent: Nov. 7, 2006

(54) IMAGE FORMING METHOD AND APPARATUS INCLUDING AS EASY-TO-HANDLE LARGE CAPACITY TONER CONTAINER

(75) Inventor: Emi Kita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 22 days.

(21) Appl. No.: 10/689,037

(22) Filed: Oct. 21, 2003

(65) Prior Publication Data

US 2004/0131390 A1 Jul. 8, 2004

Related U.S. Application Data

(63) Continuation-in-part of application No. 10/412,390, filed on Apr. 14, 2003, now Pat. No. 6,882,817.

(30) Foreign Application Priority Data

Apr. 12, 2002 (JP) ..... 2002-110525
Feb. 17, 2003 (JP) ..... 2003-38211

(51) Int. Cl.
*G03G 15/08* (2006.01)
*G03G 15/04* (2006.01)

(52) U.S. Cl. ..... 399/258; 399/119; 399/262

(58) Field of Classification Search ..... 399/119, 399/120, 252, 254, 258, 262, 263; 222/DIG. 1
See application file for complete search history.

(56) References Cited

U.S. PATENT DOCUMENTS 5,248,847 A * 9/1993 Aoyama ..... 222/DIG. 1 X
5,268,719 A * 12/1993 Rydelek et al. .... 222/DIG. 1 X
5,282,002 A * 1/1994 Jacobs et al. ..... 399/119
5,313,993 A * 5/1994 Corby et al. ..... 222/DIG. 1 X
5,953,567 A * 9/1999 Muramatsu et al. ... 222/DIG. 1 X
6,628,915 B1 * 9/2003 Muramatsu et al. ..... 399/258
6,678,492 B1 * 1/2004 Terazawa et al. ..... 399/258
2001/0051062 A1 * 12/2001 Yanagisawa et al. ..... 399/258
2002/0009310 A1 * 1/2002 Kabumoto et al. ..... 399/258

FOREIGN PATENT DOCUMENTS

| | | |
|---|---|---|
| JP | 60-118157 | 9/1985 |
| JP | 06-149048 | 5/1994 |
| JP | 06-242677 | 9/1994 |
| JP | 2001-242762 | 9/2001 |
| JP | 2001-305843 | 11/2001 |
| JP | 2002-99130 | 4/2002 |

OTHER PUBLICATIONS

U.S. Appl. No. 11/113,174, filed Apr. 25, 2005, Katsuyama et al.
U.S. Appl. No. 10/912,058, filed Aug. 6, 2004, Miki.

* cited by examiner

*Primary Examiner*—Sandra L. Brase
(74) *Attorney, Agent, or Firm*—Oblon, Spivak, McClelland, Maier & Neustadt, P.C.

(57) ABSTRACT

An image forming apparatus including a development mechanism for developing an electrostatic latent image formed on an image carrying member into a visual image, a toner storage detachably installed and provided for storing toner therein, a toner transporting mechanism for transporting the toner from the toner storage to the development mechanism, and a supporting device for detachably supporting the toner storage therein and moving between a set position at which the toner storage is engaged with the toner transporting mechanism and a tilt position at which the toner storage is disengaged from the toner transporting mechanism.

8 Claims, 20 Drawing Sheets

IMAGE FORMING METHOD AND APPARATUS INCLUDING AS EASY-TO-HANDLE LARGE CAPACITY TONER CONTAINER

CROSS-REFERENCE TO RELATED APPLICATIONS

This patent application is a continuation-in-part application of U.S. patent application Ser. No. 10/412,390 and claims priority to U.S. patent application Ser. No. 10/412,390, filed Apr. 14, 2003, now U.S. Pat. No. 6,882,817, in the United States Patent and trademark Office, and Japanese patent applications, Nos. JPAP 2002-110525 filed on Apr. 12, 2002, and JPAP 2003-38211 filed on Feb. 17, 2003, in the Japanese Patent Office. The entire contents of these documents are incorporated herein by reference.

BACKGROUND OF THE INVENTION

The present invention relates to an image forming method and apparatus, and more particularly to an image forming method and apparatus which includes an easy-to-handle large capacity toner container.

Conventionally, an electrophotographic image forming apparatus uses a development mechanism which develops an electrostatic latent image formed on an image carrying member into a visual image. In particular, an electrophotographic image forming apparatus using a two-component developer for the development mechanism adopts a specific structure in which a toner storage such as a toner bottle, a toner cartridge, a toner tank, and the like is arranged close to the development mechanism and toner is transported with a transportation mechanism such as an auger.

In addition, an electrophotographic image forming apparatus provided with a color capability as a recent trend has four development mechanisms with four toner storages for colors of yellow, magenta, cyan, and black.

It is a general requirement for such an image forming apparatus to have a compact size without sacrificing a capacity of the toner storage. However, the toner storage is needed to be arranged close to the development mechanism in an engine of the image forming apparatus and therefore the reduction in size of the engine is constrained. Accordingly, flexibility of a machine design itself is interfered.

Japanese Laid-Open Patent Application Publication, No. 2001-305843, describes an image forming apparatus which has a toner storage arranged in a separate unit from a development mechanism since the toner contained in the toner storage is transported to the development mechanism with a screw pump called a mohno-pump.

Generally, an image forming apparatuses capable of performing functions of copying, printing, and facsimile, for example, has a relatively large machine size and, in such an apparatus, a dead space (i.e., unutilized space) may often be found underneath an operation panel thereof. If a toner storage is placed in this dead space, a large amount of toner can be stocked in the apparatus without the needs of further enlarging the machine size. However, since the top of this dead space is covered by the operation panel, an exchange of the toner storage is not easily performed.

BRIEF SUMMARY OF THE INVENTION

In view of the foregoing, it is an object of the present invention to provide a novel image forming apparatus which can store a large capacity of toner without sacrificing exchangeability of a toner storage.

Another object of the present invention is to provide a novel image forming method which can store a large capacity of toner without sacrificing exchangeability of a toner storage.

To achieve the above-mentioned object, in one example, a novel image forming apparatus includes a development mechanism, a toner storage, and a toner transportation mechanism. The development mechanism is configured to develop an electrostatic latent image formed on an image carrying member into a visual image. The toner storage is detachably installed in the apparatus and is configured to store toner therein. The toner transportation mechanism is configured to transport the toner from the toner storage to the development mechanism. In this apparatus, the toner storage is movable together with at least a part of the toner transportation mechanism between a closed position which is a normal position of the toner storage containing toner and a tilt position at which the toner storage is exchanged with a new toner storage.

The toner transportation mechanism may include a flexible tube for transporting the toner from the toner storage to the development mechanism.

The toner transportation mechanism may include a screw pump including an elastic stator internally having spiral grooves in a two-screw shape and a rotor rotating inside the stator to transport the toner in an axis direction, and the toner is transported to the development mechanism by an action of a negative pressure generated by the screw pump.

The toner storage may be movable between the closed position and the tilt position by a rotational movement.

The flexible tube may be arranged near a rotation shaft of the toner storage.

The flexible tube may include at least two tube portions joined with a connector arranged near the rotation shaft of the toner storage.

At least one of the above-mentioned at least two tube portions included in the flexible tube may be made of a material different from materials of the others.

To achieve the above-mentioned object, in one example, a novel image forming method includes the steps of providing, setting, storing, and transporting. The providing step provides a development mechanism developing an electrostatic latent image into a visual image with toner. The setting step sets a toner transportation mechanism. The storing step stores toner in a detachable toner storage. The transporting step transports the toner with the toner transportation mechanism from the detachable toner storage to the development mechanism. In this method, the detachable toner storage is movable together with at least a part of the toner transportation mechanism between a closed position which is a normal position of the detachable toner storage containing toner and a tilt position at which the detachable toner storage is exchanged with a new detachable toner storage.

The toner transportation mechanism may include a flexible tube for transporting the toner from the detachable toner storage to the development mechanism.

The toner transportation mechanism may include a screw pump including an elastic stator internally having spiral grooves in a two-screw shape and a rotor rotating inside the stator to transport the toner in an axis direction, and the toner is transported to the development mechanism by an action of a negative pressure generated by the screw pump.

The detachable toner storage may be movable between the closed position and the tilt position by a rotational movement.

The flexible tube may be arranged near a rotation shaft of the detachable toner storage.

The flexible tube may include at least two tube portions joined with a connector arranged near the rotation shaft of the detachable toner storage.

At least one of the above-mentioned at least two tube portions included in the flexible tube may be made of a material different from materials of the others.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
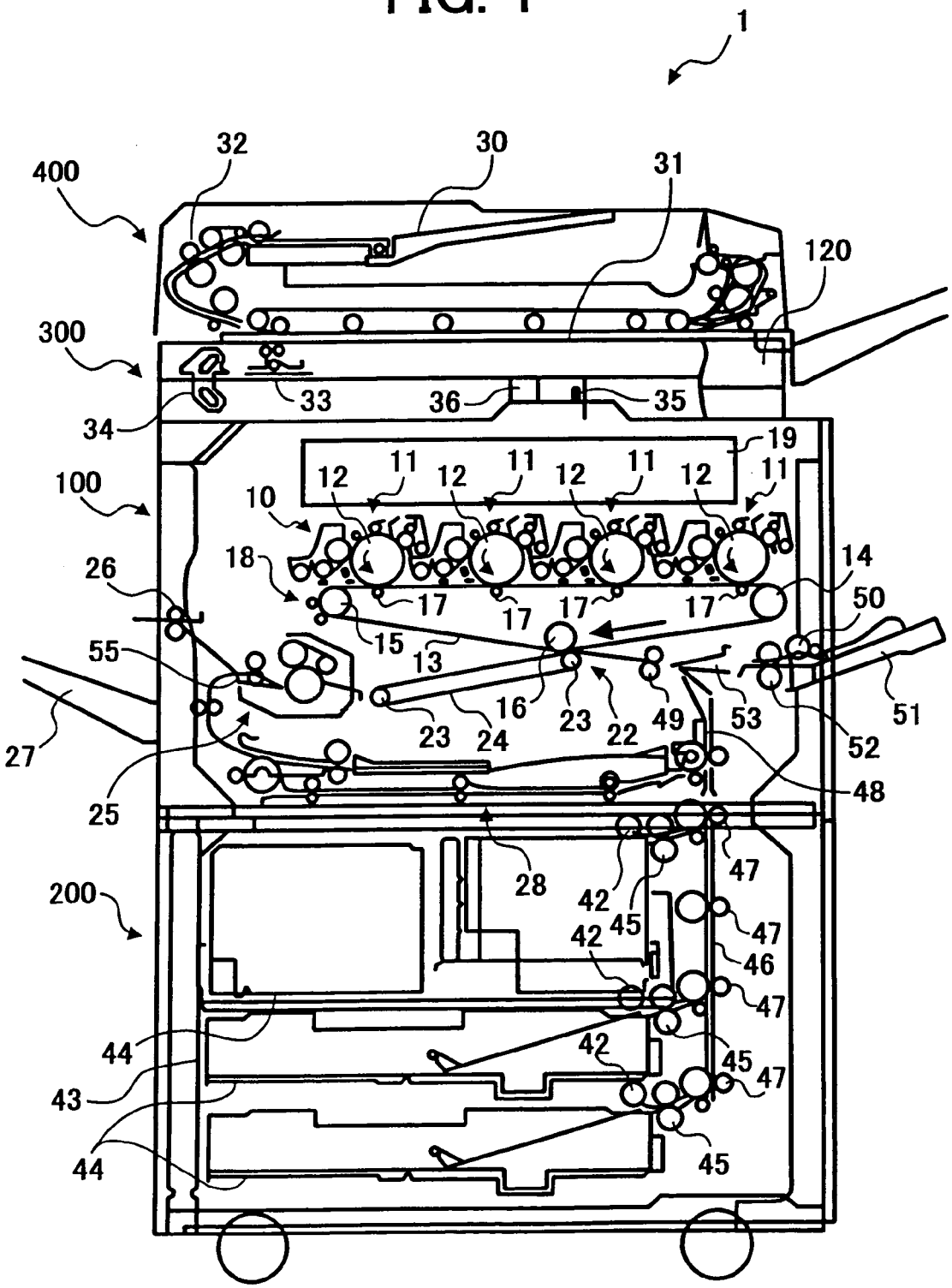
FIG. 1 is a schematic diagram of a color copying apparatus according to an exemplary embodiment of the present invention.

In describing the exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, a color copying apparatus 1 is explained, which is one example of a color image forming apparatus according to a preferred embodiment of the present invention. The color copying apparatus 1 forms an image using an electrophotographic method and, as shown in FIG. 1, includes a color copying engine 100 at the middle, a sheet supply station 200 at the bottom, and an image scanner 300 at the top of the color copying apparatus 1 with an automatic document feeder (ADF) 400 on top. In addition, the color copying apparatus 1 is also provided with an operation panel 120 in front of and in an integrated form with the image scanner 300. Those skilled in the art will recognize that the above components may be located at alternative positions within the apparatus in addition to those mentioned above.

The color copying engine 100 is provided with a tandem mechanism 10 including four image forming units 11 arranged horizontally for black (Bk), cyan (C), magenta (M), and yellow (Y) colors. Each of the four image forming units 11 includes a photosensitive drum 12 which serves as a primary image carrying member for carrying a latent image formed thereon. Around the photosensitive drum 12, various requisite mechanisms for the electrophotographic process, as explained herein.

Below the tandem mechanism 10, an intermediate transfer belt 13 is extended under a predetermined tension among a plurality of rollers 14, 15, and 16, and is arranged to contact the four photosensitive drums 12. The intermediate transfer belt 13 includes a flexible endless belt and serves as a secondary image carrying member for carrying a toner image. One of the rollers 14, 15, and 16 is driven to rotate the intermediate transfer belt 13 clockwise, as indicated by an arrow. Other rollers which are not directly driven follow the rotation.

The color copying engine 100 is further provided with four primary image transfer units 17 which contact an inside surface of the intermediate transfer belt 13 at positions to face the respective photosensitive drums 12 via the intermediate transfer belt 13. Reference numeral 18 denotes a cleaning unit for removing unused toner particles from the intermediate transfer belt 13.

Above the tandem mechanism 10, an exposure unit 19 for sequentially irradiating each of the photosensitive drums 12 with an optically-modulated laser beam is provided. The exposure is performed at an area after a charging process and before a development process. Instead of the single exposure unit 19, four separate exposure units may be provided to be used on a one-to-one basis relative to each of the photosensitive drums 12. In the exemplary embodiment, the single exposure unit 19 is utilized to decrease cost.

Underneath the intermediate transfer belt 13, a secondary image transfer unit 22 is provided. The secondary image transfer unit 22 includes a secondary image transfer belt 24 which is an endless belt and is extended between two rollers 23. The secondary image transfer unit 22 is arranged such that a portion of the secondary image transfer belt 24 close to one of the rollers 23 presses the intermediate transfer belt 13 against the roller 16. Near the other one of the rollers 23 and below the roller 15, a fixing unit 25 for fixing a toner image carried by and on a recording sheet is provided.

The secondary image transfer unit 22 further includes a sheet transport mechanism for transporting a recording sheet carrying a toner image thereon to the fixing unit 25. As an alternative to the secondary image transfer unit 22, a non-contact charging unit may be used. With such a non-contact charging unit, a mechanism for transporting a recording sheet carrying a toner image thereon to the fixing unit 25 may be installed separately.

The color copying engine 100 is further provided with a pair of sheet ejection rollers 26 for ejecting a recording sheet carrying a toner image fixed thereon and an output tray 27 for storing recording sheets output from the color copying engine 100.

The color copying engine 100 is further provided with a sheet flipping unit 28 for flipping a recording sheet having a front surface already printed so as to print an image on a back side of the recording sheet in a dual surface copying mode. The sheet flipping unit 28 is arranged under the secondary image transfer unit 22 and the fixing unit 25.

When a color copying is performed with the color copying apparatus 100, a set of originals are placed in a face-up orientation on an original input stacker 30 of the ADF 400. Alternatively, the set of originals can manually be placed sheet by sheet directly on a contact glass 31 of the image scanner 300. To do this, the ADF 400 is lifted up since it has a shell-like openable structure and, after the placement of the original, the ADF 400 is lowered to a closing position.

Then, upon a depress of a start switch (not shown), when the set of originals are placed on the ADF 400, an uppermost original of the set of originals is separated and is transported with a sheet transportation mechanism 32 of the ADF 400 to the contact glass 31 of the image scanner 300 and, subsequently, the image scanner 300 is activated. That is, first and second moving units 33 and 34 of the image scanner 300 slide in a predetermined direction. When the original is manually set on the contact glass 31, the image scanner 300 is immediately activated upon the depress of the start switch. The first moving unit 33 that carries a light source and a mirror (both not shown) causes a light irradiation to move and reflects the light reflected by the original on the contact glass 31. The second moving unit 34 carrying mirrors (not shown) receives the light reflected by the mirror of the first moving unit 33 and reflects the light to a read sensor 35 via an image forming lens 36.

Also, upon the depress of the start switch, the image forming units 11 are activated to form mono-color images in black, yellow, magenta, and cyan on the respective photosensitive drums 12 in the tandem mechanism 10. At the same time, the intermediate transfer belt 13 starts to rotate and sequentially receives the mono-color images at a same position thereof, thereby forming a composite color image.

Further, upon the depress of the start switch, one of sheet supply rollers 42 of the sheet supply station 200 is started to rotate so that a blank recording sheet is moved to a separation roller 45 in a corresponding sheet stocker 44 among a plurality of sheet stockers 44 provided to a sheet bank 43. The separation roller 45 separates the recording sheet from the following sheets and transfers it to a transportation passage 46. Then, the recording sheet is moved to a transportation passage 48 provided to the color copying engine 100 by a plurality of transportation rollers 47. The recording sheet is then stopped by a pair of registration rollers 49.

When a manual insertion is used, a transportation roller 50 is rotated to move a set of recording sheets placed on a manual insertion tray 51 to a pair of separation rollers 52. Then, the pair of separation rollers 52 separate an uppermost recording sheet from the rest of the recording sheets and transfers it to the pair of registration rollers 49 through a transportation passage 53.

After that, the pair of registration rollers 49 are started to rotate in synchronism with the movement of the composite color image carried on the intermediate transfer belt 13 and consequently the recording sheet which is blank is inserted between the intermediate transfer belt 13 and the secondary image transfer unit 22. The composite color image is transferred at one time from the intermediate transfer belt 13 onto the recording sheet by the action of the secondary image transfer unit 22.

After the image transfer, the secondary image transfer unit 22 transports the recording sheet having the composite color image to the fixing unit 25 which then fixes the color image to the recording sheet with heat and pressure. Then, the recording sheet passes through an ejection passage selected by a switch pawl 55 and is ejected to the output tray 27 by the pair of sheet ejection rollers 26. As an alternative, the recording sheet may be headed to the sheet flipping unit 28 by selecting a transportation passage for the dual surface copying mode with the switch pawl 55. In this case, the recording sheet is flipped by the sheet flipping unit 28 and is then transported again to the pair of registration rollers 49 in a face-down orientation. Then, the recording sheet is caused again to pass through the passage between the intermediate transfer belt 13 and the secondary image transfer unit 25 to receive a composite color image on the back surface thereof. After that, the recording sheet with the front and back sides printed passes through the ejection passage selected by the switch pawl 55 and is ejected to the output tray 27 by the pair of sheet ejection rollers 26.

After the image transfer, the intermediate transfer belt 13 further moves to undergo a cleaning of unused toner particles by the cleaning unit 18 and to become ready for a next image transfer process.

Figure 2:
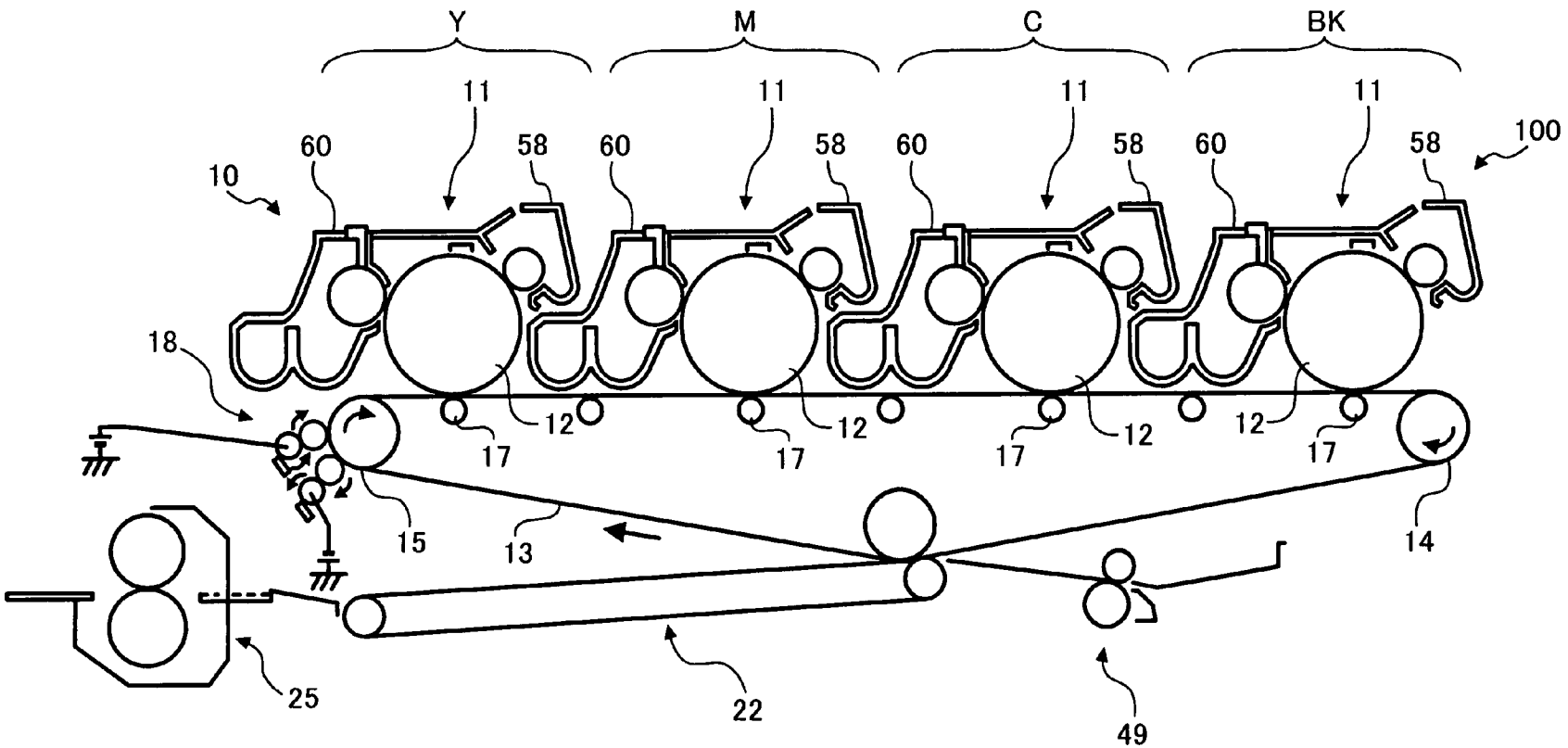
FIG. 2 is a schematic diagram of a major portion of a color copying engine included in the color copying apparatus of FIG. 1.

FIG. 2 shows a major portion of the color copying engine 100 in the color copying apparatus 1. As indicated in FIG. 2, in the tandem mechanism 10, the four image forming units 11 for the colors of Y, M, C, and Bk are arranged in this order in the exemplary embodiment from an upstream side to a downstream side in a moving direction of the intermediate transfer belt 13 in a horizontal area between the rollers 14 and 15 where the four image forming units 11 contact the intermediate transfer belt 13. With this order, a "first copy time" of a copying operation in black can be shortened by a time period corresponding to a length from the most upstream photosensitive drum 12 for the color Y to the most downstream photosensitive drum 12 for the color Bk.

Figure 3:
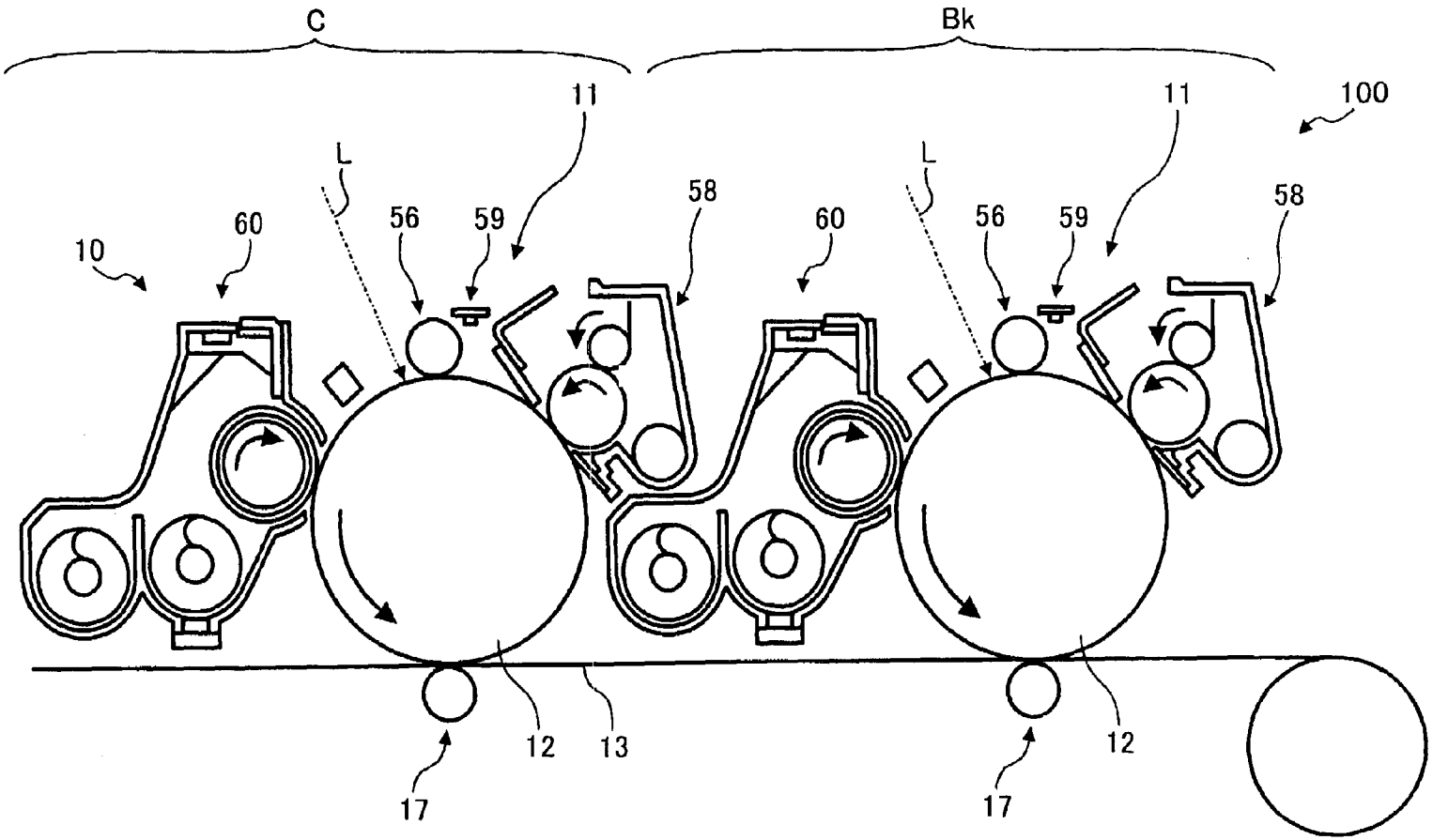
FIG. 3 is a part of the major portion of the color copying engine shown in FIG. 2 with an enlargement.

FIG. 3 enlarges the image forming units 11 for the colors of C and Bk, for example, as a portion of the tandem mechanism 10. As shown in FIG. 3, in the image forming unit 11 for the color of C, for example, the photosensitive drum 12 is surrounded by a charging unit 56, a development unit 60, the secondary image transfer unit 17, a cleaning unit 58, and a discharging unit 59. A laser light beam L runs to the photosensitive drum 12 between the charging unit 56 and the development unit 60.

Figure 4:
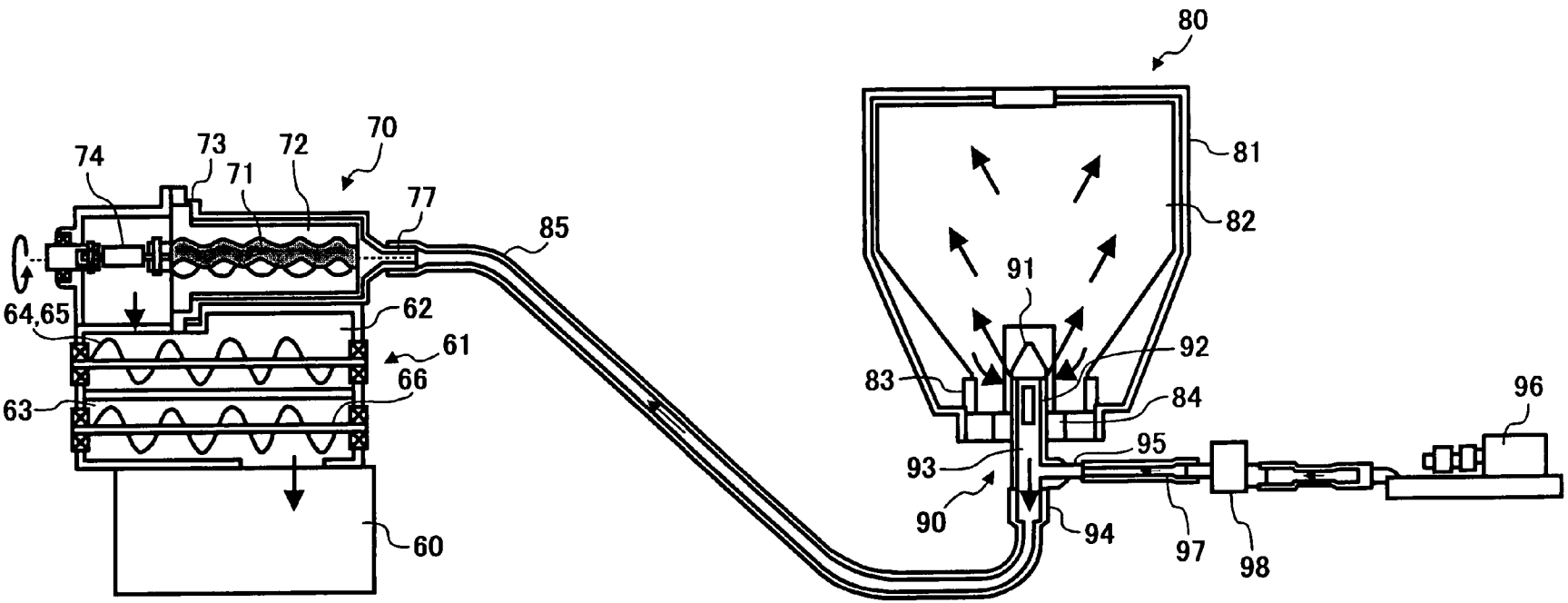
FIG. 4 is a schematic diagram of a toner replenishing mechanism included in the color copying apparatus of FIG. 1.

FIG. 4 shows a toner replenishing mechanism for replenishing the development unit 60 of the image forming unit 11 with toner. In FIG. 4, a toner container 80 contains toner which is transferred to the development unit 60. This toner container 80 is enclosed by an enclosure 110 (see FIG. 8) of the color copying engine 100. The enclosure 110 is provided with a nozzle 90 which is inserted into the toner container 80. When the toner container 80 is exchanged and a new one is inserted downwardly into the enclosure 110, the nozzle 90 is inserted upwardly into the new toner container 80. The nozzle 90 has a tubular structure and is provided with an upper end 91 in a cone-like shape having a pointed top. The upper end 91 is integrated with the nozzle 90 or is adhered to the nozzle 90. The nozzle 90 is provided with an opening 92 for exchanging air and taking in the toner at a position below the upper end 91. The nozzle 90 includes a passage 93 connected to the opening 92 and which is provided with a connection end 94 for connecting a toner transportation tube 85 for transporting toner therethrough. The passage 93 is also provided with an air inlet 95 at a position above the connection end 94.

In this embodiment, an air pump 96 is connected to the air inlet 95 with an air transportation pipe 97. When the air pump 96 is in operation, it discharges the air in a confined jet to inside the toner container 80 from the bottom via the air transportation pipe 97 and the passage 93. The jet air entered inside the toner container 80 agitates the toner and fluidizes the toner in the toner container 80.

The toner container 80 includes an external case 81 serving as a protection cover and a toner sack 82 stored inside the external case 81. The toner sack 82 is flexible and exchangeable. The external case 81 is made of a rigid paper material such as a corrugated cardboard or a plastic material, for example, and has an internal space for storing the toner sack 82. The thus-structured toner container 80 is an easy-to-handle container since the flexible toner sack 82 is protected from an external impact with the external case 81.

The toner sack 82 is made of at least one flexible sheet material such as a polyester film, a polyethylene film, or the like having a thickness of the order of from about 80 μm to 125 μm. The toner sack 82 has an opening with a ring-shaped portion 83 at a bottom center thereof for discharging the toner. The ring-shaped portion 83 is made of plastic such as polyethylene, nylon, or the like. The opening with the ring-shaped portion 83 is provided with a seal 84 serving as a self-closing valve. The seal 84 includes at least one layer of seal and is made of an elastic material including a sponge foam or the like. The toner sack 82 has a tapered width decreasing as close to the opening with the ring-shaped portion 83 so that the toner cannot remain inside the toner sack 82.

With the thus-structured toner container 80, when the toner container 80 is inserted downwardly into the enclosure 110, the nozzle 90 is inserted upwardly into the toner container 80.

A mechanical shutter may be provided to the toner container 80 to automatically close the opening with the ring-shaped portion of the toner sack 82 when the toner sack 82 is removed from the toner container 80.

Figure 5:
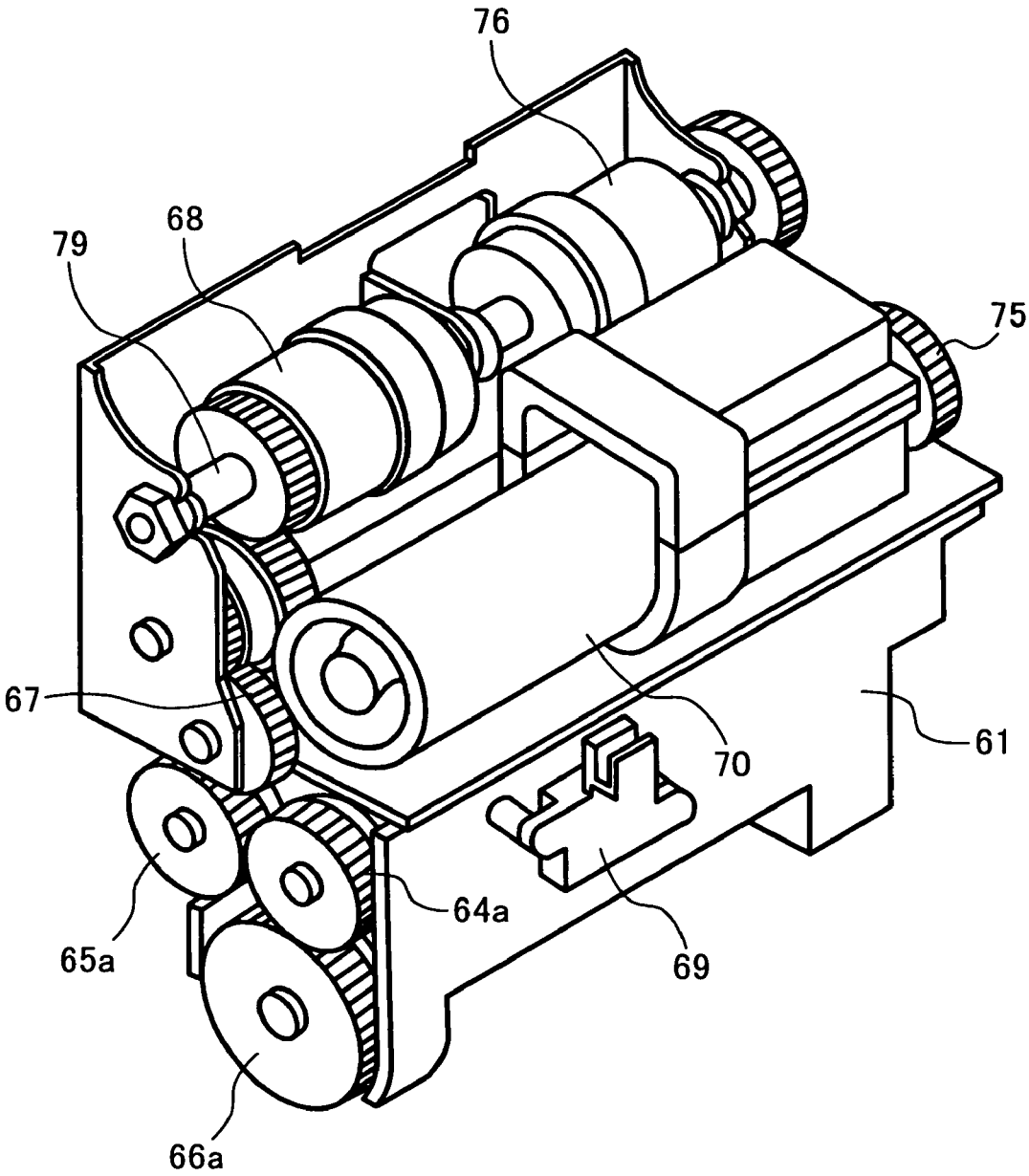
FIG. 5 is a schematic diagram of a toner replenishing mechanism including a powder pump and a sub-hopper.

As shown in FIG. 4, the development unit 60 is provided with a sub-hopper 61 on the top thereof. The toner discharged from the toner container 80 is temporarily stored in the sub-hopper 61. The sub-hopper 61 is provided with a powder pump 70 on the top thereof. The powder pump 70 transports the toner discharged from the toner container 80 to the sub-hopper 61. The powder pump 70 is a pump having a single eccentric screw. The powder pump 70 includes a rotor 71, a stator 72, and a holder 73. The rotor 71 is made of rigid metal and formed in an eccentric screw shape. The stator 72 is made of elastic material such as a rubber and internally has spiral grooves in a two-screw shape. The holder 73 stores the rotor 71 and the stator 72, and is made of the plastic material same as that used for the passage for transporting the toner. The rotor 71 is stored inside the stator 72 and is connected with a driving gear 74 using a pin connector so that the rotor 71 can be driven for rotation by the driving gear 74 and, as a result, the toner inside the stator 72 is transported to the sub-hopper 61 by an action of a negative pressure generated by the rotation of the rotor 71 in the powder pump 70. A gear 75 (see FIG. 5) integrally formed with the driving gear 74 is connected with a first clutch 76 via an idle gear (not shown). By switching the first clutch 76 between connection and disconnection, the operation of the powder pump 70 is controlled. The first clutch 76 and a second clutch 68 (later explained) are provided to a rotation driving shaft 79, as shown in FIG. 5, which is driven by a driving mechanism (not shown).

The holder 73 includes a toner sucking portion 77 at an end thereof, a right end of the holder 73 in FIG. 4, to which the above-mentioned toner transportation tube 85 is connected. The toner transportation tube 85 preferably is a flexible tube having a diameter of from about 4 mm to 10 mm, for example, and is made of a rubber material having a superior anti-toner characteristic, such as polyurethane, nitrile, EPDM (ethylene-propylene-diene-methylene), silicon, or the like. Such toner transportation tube 85 can be bent easily and arbitrarily in any direction.

When the toner discharging portion of the toner container 80 is positioned lower than a toner receiving portion of the sub-hopper 61 in the vertical direction, the toner can smoothly be transported from the toner container by using the above-mentioned powder pump 70.

Figure 6:
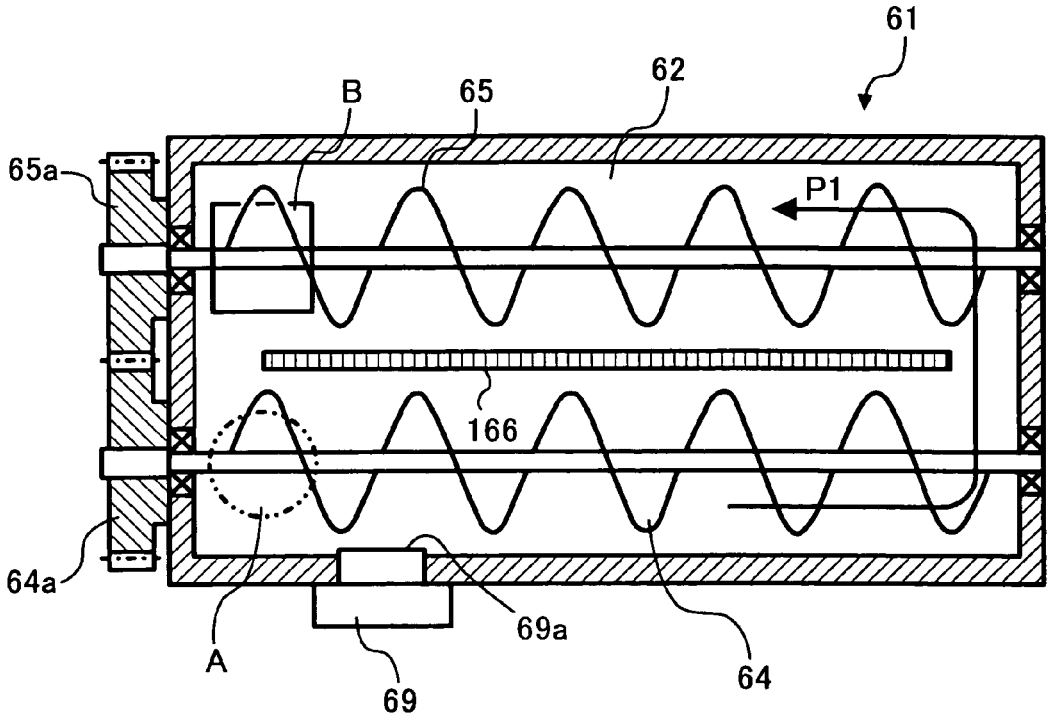
FIG. 6 is a top view of an upper chamber of the sub-hopper.
Figure 7:
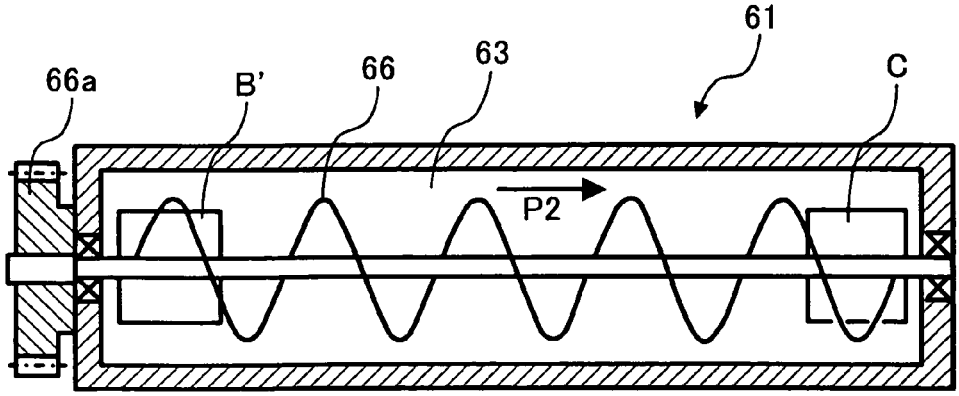
FIG. 7 is a top view of a lower chamber of the sub-hopper.

The sub-hopper 61 is divided into an upper chamber 62 and a lower chamber 63. As shown in FIGS. 6 and 7, where FIG. 6 is a top view of the upper chamber 62 and FIG. 7 is a top view of the lower chamber 63, the upper chamber 62 has a larger floor area than the lower chamber 63 and is provided with a pair of upper screws 64 and 65 and a partition 166 having two cut ends, left and right cut ends in FIG. 6, where the partition 166 is positioned between the pair of upper screws 64 and 65 and the two cut ends are shorter than an internal width of the upper chamber 62. In FIG. 6, a position A in the upper chamber 62 indicated by a circular mark with a partly-dotted line is a position to which the toner transported by the powder pump 70 is supplied. The toner supplied at the position A is transported within the upper chamber 62 in a direction P1 by the rotations of the upper screws 64 and 65. An opening B in the upper chamber 62 indicated by a square mark with a solid line is an opening connecting inside spaces of the upper chamber 62 and the lower chamber 63. That is, the toner moved along in the direction P1 by the upper screws 64 and 65 is transferred to a region around the connecting opening B and drops down to an inside floor of the lower chamber 63 by its weight through the opening B.

As shown in FIG. 7, the lower chamber 63 is provided with a lower screw 66. A position B' in the lower chamber 63 indicated by a square mark with a solid line is a position to which the toner falls from the upper chamber 62. The toner received at the position B' is transported within the lower chamber 63 in a direction P2 by the rotation of the lower screw 66. An opening C in the lower chamber 63 indicated by a square mark with a solid line is a toner replenishing opening connecting inside spaces of the lower chamber 63 and the development unit 60. That is, the toner moved along in the direction P2 by the lower screw 66 is transferred to a region around the opening C and drops down to an inside floor of the lower chamber 63 by its weight through the opening C.

The sub-hopper 61 is thus structured so that the toner transported by the powder pump 70 is temporarily stored and is transferred to the development unit 60 by the upper screws 64 and 65 and the lower screw 66. That is, these upper screws 64 and 65 and the lower screw 66 serve as a toner transportation mechanism in the sub-hopper 61. In addition, as shown in FIG. 5, the upper screws 64 and 65 and the lower screw 66 are provided with gears 64*a*, 65*a*, and 66*a*, respectively, which are connected via a group of idle gears 67 with a second clutch 68 provided to the driving shaft 79 so that the operations of the upper screws 64 and 65 and the lower screw 66 are controlled by the second clutch 68 which turns on and off.

Further, the sub-hopper 61 is provided with a toner sensor 69 for detecting the toner in the upper chamber 62 when an amount of toner exceeds a predetermined value. The toner sensor 69 is located at a position on a wall near the position A of the upper chamber 62. The toner sensor 69 is a vibration type sensor having a detection surface 69*a*, as shown in FIG. 6, for detecting the toner in the upper chamber 62 when an amount of toner exceeds the predetermined value.

The thus-structured toner replenishing mechanism starts its operation upon a receipt of an instruction signal for replenishing the toner to the development unit 60 from a toner density sensor (not shown), for example. In the toner replenishing operation, the second clutch 68 is turned on to drive the upper screws 64 and 65 and the lower screw 66 so as to supply the toner to the development unit 60 by an amount according to a length of time that the screws are driven. At the same time, the toner sensor 69 monitors the toner amount in the sub-hopper 61. Upon a detection by the toner sensor 69 that the toner amount decreases under a predetermined amount, the powder pump 70 is activated to transport the toner of the toner container 80 to the sub-hopper 61. This process can be performed without the needs of a high accuracy in controlling the amount of the toner replenishment to the sup-hopper 61. Accordingly, the amount of toner to be transported by the powder pump 70 is determined to be greater than an amount of toner to be transferred from the sub-hopper 61 to the development unit 60 by the upper and lower screws.

In addition, if the toner amount detected by the toner sensor 69 maintains under the predetermined amount even with plural times of the toner replenishing operation by the powder pump 70, the toner container 80 is judged as nearly empty, which is referred to as a toner near-end status. When the toner near-end status is detected, a caution for an exchange of the toner container 80 is displayed on an indication member (not shown), for example, of the operation panel 120. When the toner container 80 is not exchanged despite the above-mentioned display of the caution, the image forming operation is prohibited after the execution of the image forming operation a predetermined number of times.

Since the color copying apparatus 1 uses the powder pump 70 to replenish the development unit 60 with the toner of the toner container 80, the placement of the enclosure 110 for the toner container 80 is highly flexible. The enclosure 110, however, is not preferably placed at a lower part of the color copying engine 100 since a user may need to bow in exchanging the toner container 80. A top and front part of the color copying engine 100 is a preferable part for the enclosure 110 to be placed. In addition, if the toner container 80 has an insufficient toner capacity, a frequent exchange of the toner container 80 may be required and therefore the toner container 80 preferably has a sufficient capacity of toner.

Figure 8:
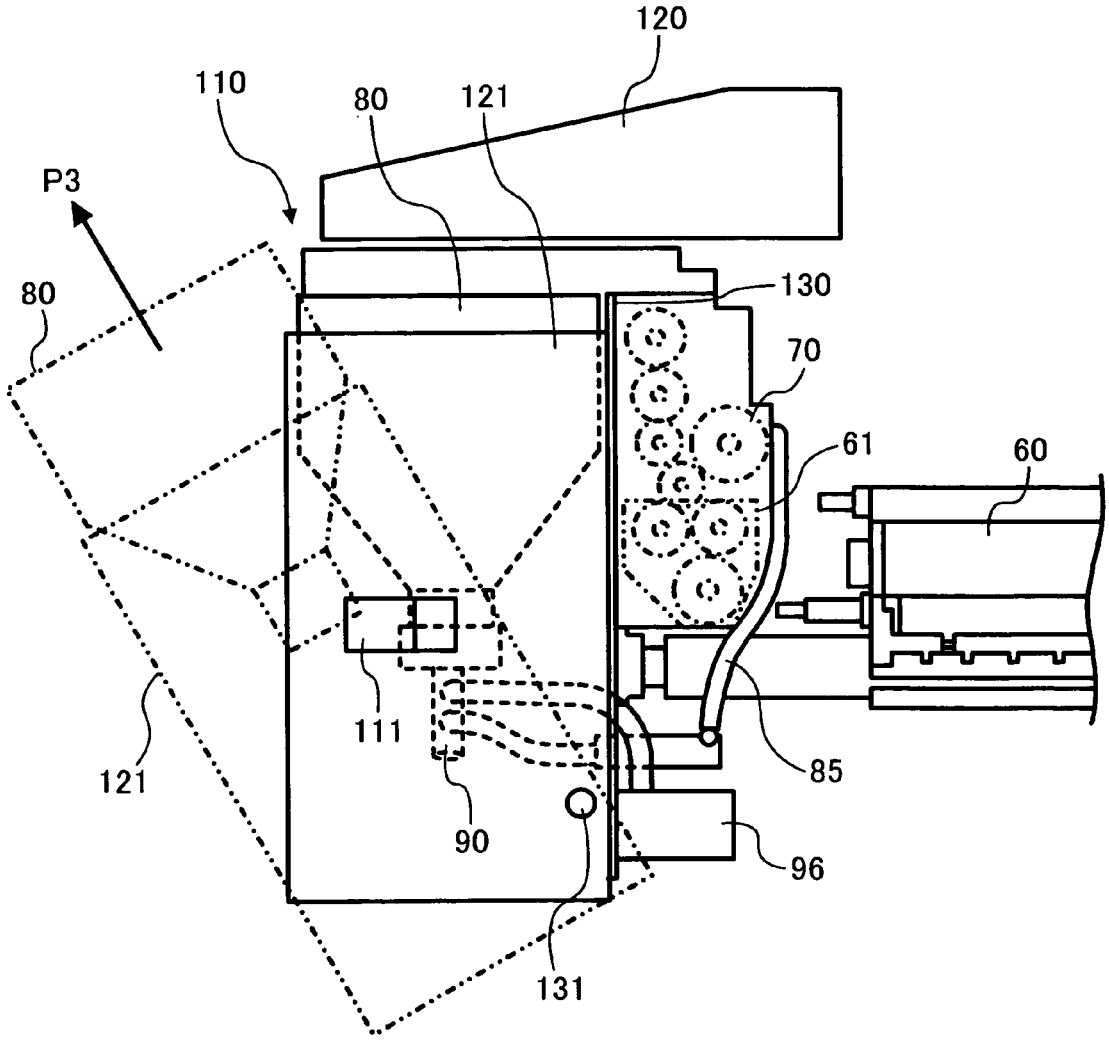
FIG. 8 is a schematic diagram for showing a tilt position of an enclosure for toner containers in association with the toner replenishing mechanism.

FIG. 8 shows the enclosure 110 for the toner container 80 which is placed at a position satisfying the above-mentioned requirements. In the exemplary embodiment, the position is located in an upper front part of the color copying engine 100 and underneath the operation panel 120. At this position, however, the insertion of the toner container into the enclosure 110 is obstructed by the operation panel 120.

In the color copying apparatus 1, the toner container 80 is configured to tilt away from the color copying engine 100, as shown in FIG. 8, so that the toner container 80 can be removed, in a direction of arrow P3, and inserted into the enclosure 110 with being obstructed by the operation panel 120. More specifically, behind the enclosure 110, there is provided a housing plate 130 which encloses a unit of the image forming mechanism including the development unit 60 and the toner replenishing mechanism including the powder pump 70. The enclosure 110 includes a holder 121 for holding the toner container 80. At a lower part of the holder 121, the nozzle 90 is mounted vertically. The holder 121 is held on the housing plate 130 for rotation about a rotation shaft 131, as shown in FIG. 8, so that the enclosure 110 can be moved to a closed position at which the enclosure 110 is fit underneath the operation panel 120, where the toner container 80 and associated components are illustrated with dotted lines, and a tilt position at which the toner container 80 can be exchanged without being obstructed by the operation panel 120, where the toner container 80 and the holder 121 are illustrated with two-dotted-chain lines. The rotation shaft 131 is provided to a position close to the housing plate 130 and in a lower part of the toner container 80.

In addition, the enclosure 110 is provided with a stopper (not shown) for engaging the enclosure 110 at the closed position and a release button 111 for releasing the engagement of the enclosure 110 at the closed position by the stopper. When the release button 111 is depressed relative to the enclosure 110 staying at the close position, the stopper is released and the enclosure 110 is tilted towards the tilt position by its own weight. Then, the enclosure 110 settles at the tilt position. After an exchange of the toner container 80, the enclosure 110 can be lifted by manually to the closed position. When the enclosure 110 comes to the closed position, the stopper automatically engages the enclosure 110 at the closed position. The stopper may include a tapered pawl with spring effect for allowing the enclosure 110 to move from the tilt position to the closed position.

Since the enclosure 110 is opposed to the powder pump 70 and the sub-hopper 61 relative to the housing plate 130, the toner transportation tube 85 has a sufficient length to be flexibly bent and is arranged to pass through a hole (not shown) provided to the housing plate 130 so as to connect the nozzle 90 with the powder pump 70. When the enclosure 110 moves between the close position and the tilt position, the toner transportation tube 85 follows the movement as it is flexible. Therefore, the toner transportation tube 85 may not cause a problem such as a breakage, a pull-out, and so forth. If the toner transportation tube 85 is excessively long, however, it may be caught on by other components causing damage during a assembly of the mechanism or exchanging the toner container 80. Therefore, it is preferable to arrange the hole of the housing plate 130 for allowing the toner transportation tube 85 to pass through at a position close to the rotation shaft 131 so that the movement of the toner transportation tube 85 is minimal.

Figure 9:
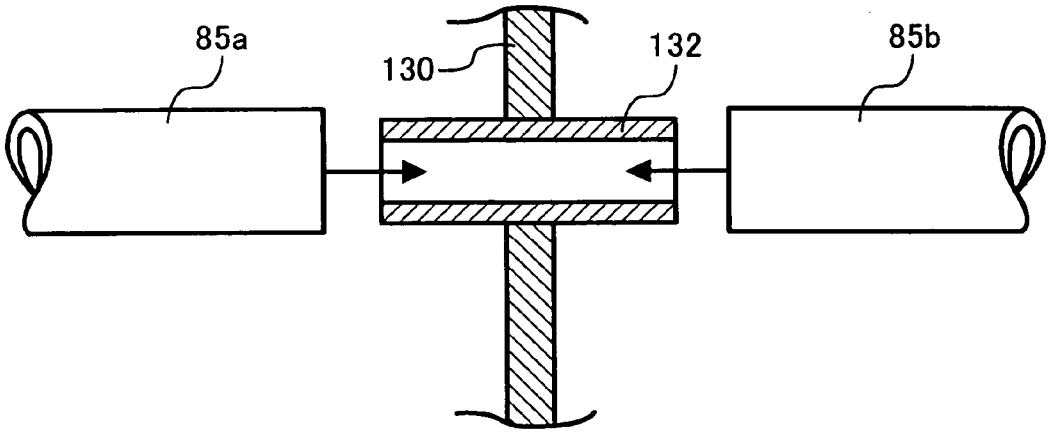
FIG. 9 is a schematic diagram of a jointed toner transportation tube for the toner replenishing mechanism.

When the toner transportation tube 85 is made of a single tube, it may be damaged by rubbing between an inner circumferential surface and an outer circumferential surface. To avoid this problem, it is preferable that the toner transportation tube 85 is made of plural tubes, as shown in FIG. 9. That is, a connection pipe 132 is provided to the hole of the housing plate 130, and first and second tubes 85*a* and 85*b* are provided. The first tube 85*a* connects between the nozzle 90 and the connection pipe 132, and the second tube 85*b* connects between the connection pipe 132 and the powder pump 70. In this case, the first tube 85*a* is caused to move as the enclosure 110 is moved but the second tube 85*b* is not caused to move since the powder pump 70 is not moved. Therefore, the first tube 85*a* is preferably made of a flexible material to follow the movement of the enclosure 110 and the second tube 85*b* is preferably made of a relatively rigid material to avoid breakage.

Figure 10:
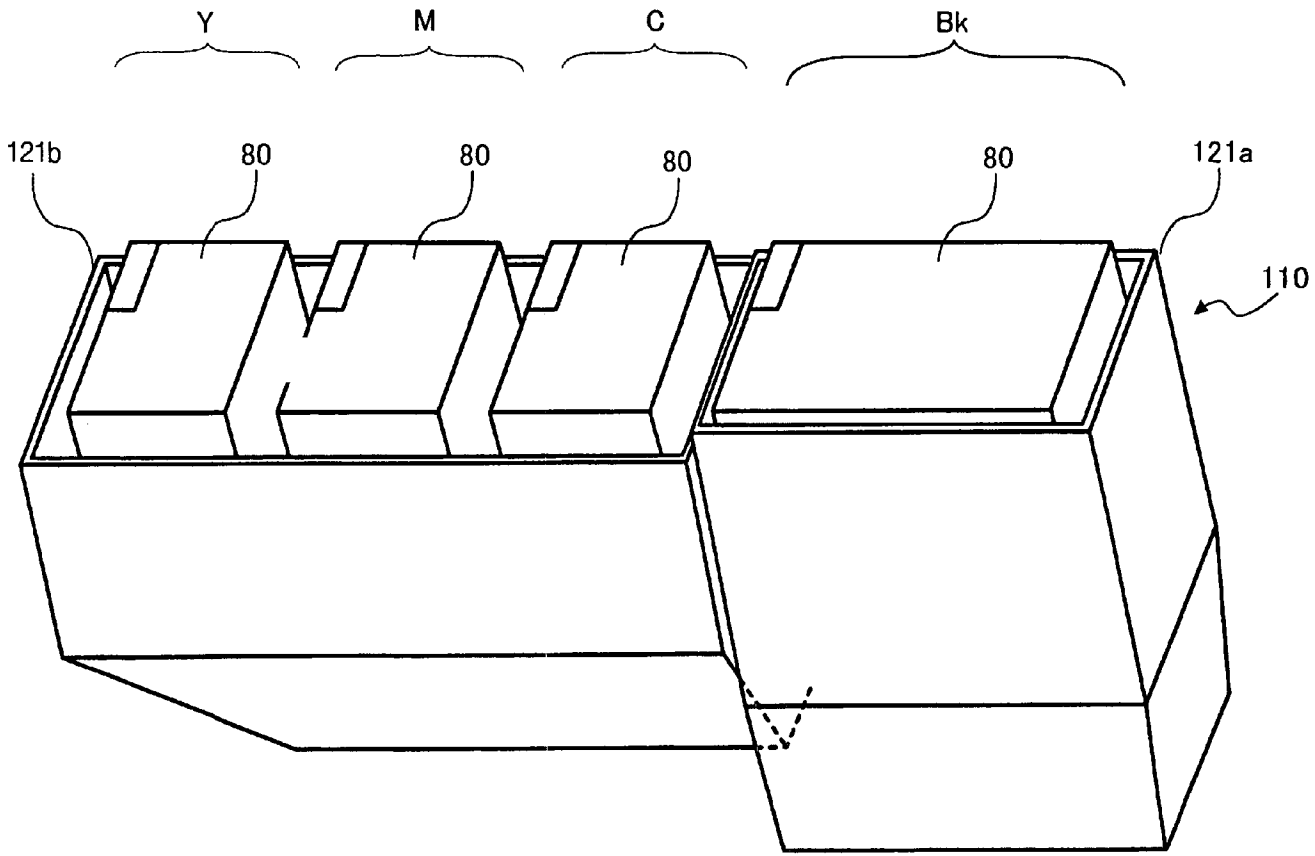
FIG. 10 is a schematic diagram showing an exemplary structure of the enclosure for the toner containers.

FIG. 10 shows an exemplary structure of the enclosure 110, where the holder 121 of the enclosure 110 is divided into first and second holders 121*a* and 121*b*. The first holder 121*a* holds the toner container 80 for the color of Bk, and the second holder 121*b* holds the toner containers 80 for the colors of Y, C, and M. As an alternative, it is possible to hold the toner containers 80 for the colors of Y, C, M, and Bk with a single holder, or four individual holders.

In addition, it is possible to install the enclosure 110 with the toner containers 80 therein inside an entire front cover of the color copying apparatus 1 for covering the inside mechanism such as the image forming mechanism, or a partial front cover prepared specifically for the enclosure 110. In the former case, the image forming operation is prohibited when the entire front cover is open to exchange the toner container 80, but in the latter case, the image forming operation is not necessarily prohibited when the partial front cover for the enclosure 110 is open to exchange the toner container 80.

When the above-mentioned partial front cover is applied to the color copying apparatus 1, the image forming operation can be executed under the conditions that the toner container 80 is in the toner near-end status, because the color copying apparatus 1 has the sub-hopper 61 and can still supply the requisite toner to the image forming operation. Accordingly, the color copying apparatus 1 does not need to stop the image forming operation and can continue the operation even when the toner near-end is detected. When the toner near-end is detected, the color copying apparatus 1 displays an instruction for exchanging the toner container 80 on the operation panel 120. The enclosure 110 may then be tilted to the tilt position to exchange the toner container 80. Upon the exchange of the toner container 80, the transportation of toner from the toner container 80 can be started by the powder pump 70 even with the enclosure 110 at the tilt position. Thus, the color copying apparatus 1 can continue the image forming operation even when the toner near-end is detected.

Further, it becomes possible for the color copying apparatus 1 to check whether the toner container 80 is correctly set to the holder 121 of the enclosure 110 when it is exchanged, by using the above-described feature of the color copying apparatus 1. That is, since the transportation of toner from the toner container 80 can be started by the powder pump 70 while the enclosure 110 stays at the tilt position, the color copying apparatus 1 can initiates the toner transportation and monitors the result of the toner transportation during the time the enclosure 110 stays at the tilt position after the tone container 80 is exchanged, thereby detecting an inappropriate setting of the toner container 80.

Figure 11:
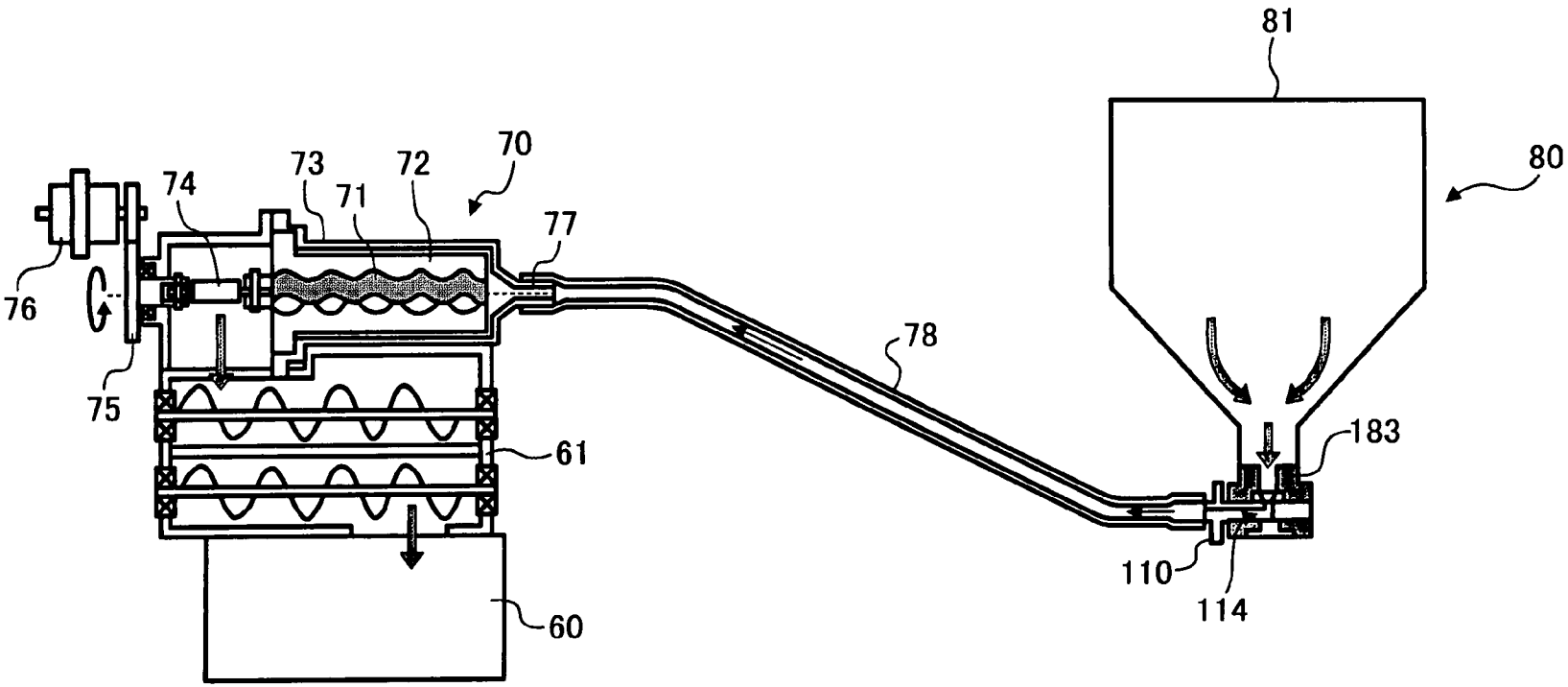
FIG. 11 is a diagram of a toner replenishing mechanism for replenishing the development unit of an image forming unit with toner.

FIG. 11 shows a toner replenishing mechanism for replenishing the development unit 60 of an image forming unit 18 with toner. The image forming unit 18 utilizes a toner transportation apparatus with a screw pump mechanism. In FIG. 11, a toner container 80 contains toner which is transferred to the development unit 60. This toner container 80 is enclosed by an enclosure 99 (FIG. 16) of the color copying engine 100. The enclosure 99 appears when a front door 100*a* (FIG. 20) of the color copying engine 100 is opened and is provided with a nozzle 110 forming a part of the toner replenishing mechanism. When the toner container 80 is placed into the enclosure 99, the nozzle 110 is inserted into the toner container 80. The nozzle 110 has a passage 110*a* therein. The passage 110*a* is connected to one end of the nozzle to communicate with a toner transportation tube 78 for transporting toner therethrough.

The toner container 80 includes a toner sack 81 which is flexible and exchangeable. The toner sack 81 is made of at least one flexible sheet material such as a polyester film, a polyethylene film, or the like having a thickness of the order of from 80 μm to 200 μm. The toner sack 81 has an opening with a single toner discharging unit 183 at a bottom center thereof for discharging the toner. The toner sack 81 also has a tapered width decreasing as close to the opening with the toner discharging unit 183 so that the toner cannot remain inside the toner sack 81.

Figure 12:
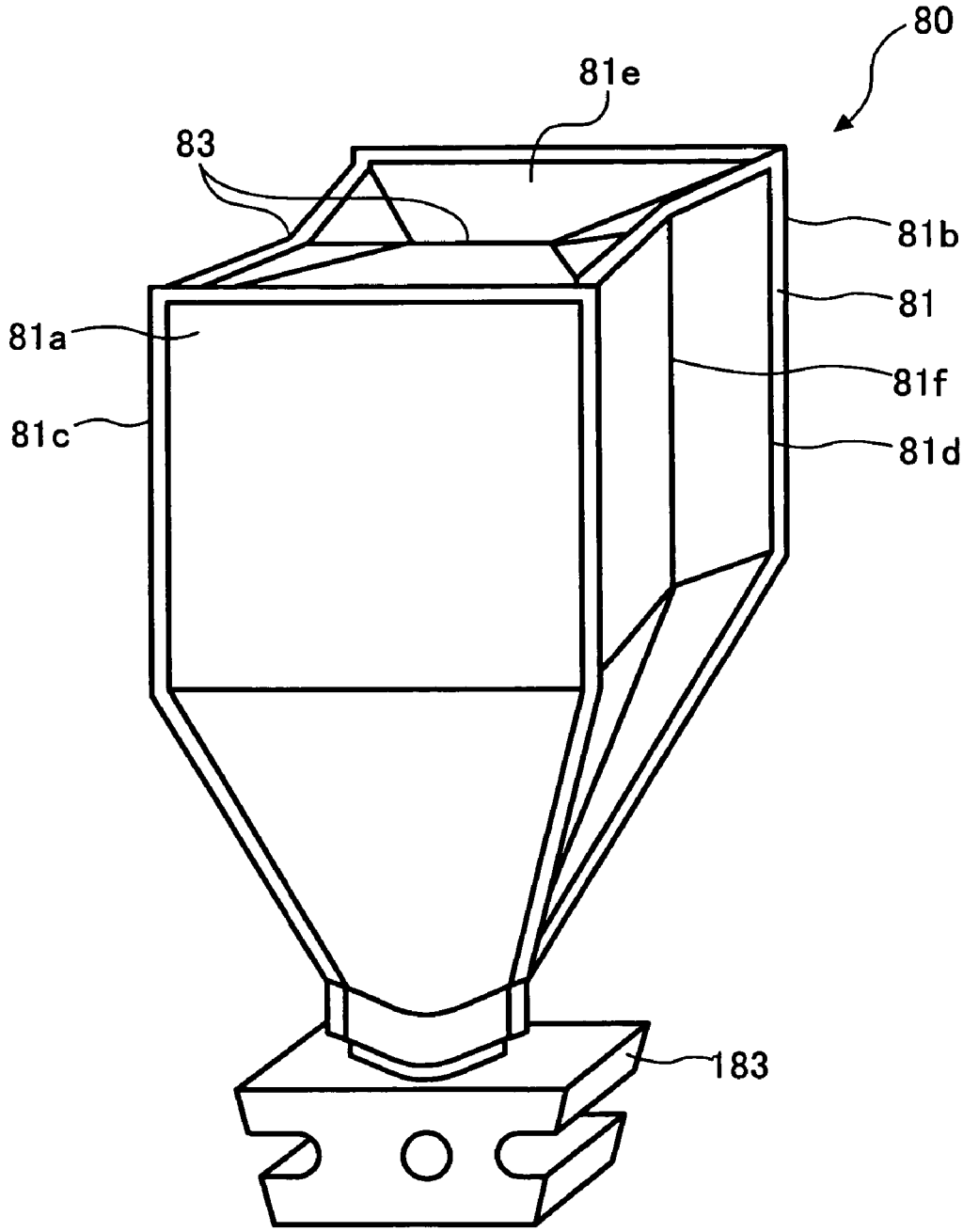
FIG. 12 is a diagram of a toner container which includes the toner sack and the toner discharging unit.

As shown in FIG. 12, the toner container 80 includes the toner sack 81 and the toner discharging unit 183. The flexible toner sack 81 includes two sheets 81*a* and 81*b* for the front and back sides, two sheets of 81*c* and 81*d* for right and left sides, and an upper sheet 81*e* attached together. The right and left side sheets 81*c* and 81*d* have folds 81*f* to inwardly fold sidewalls of the container. When the container is filled with toner, the folds 81*f* expand to be in a container shape. When the container has no toner, it is folded along the folds 81*f* to contact or closely position the front and back side sheets 81*a* and 81*b* each other.

Figure 13:
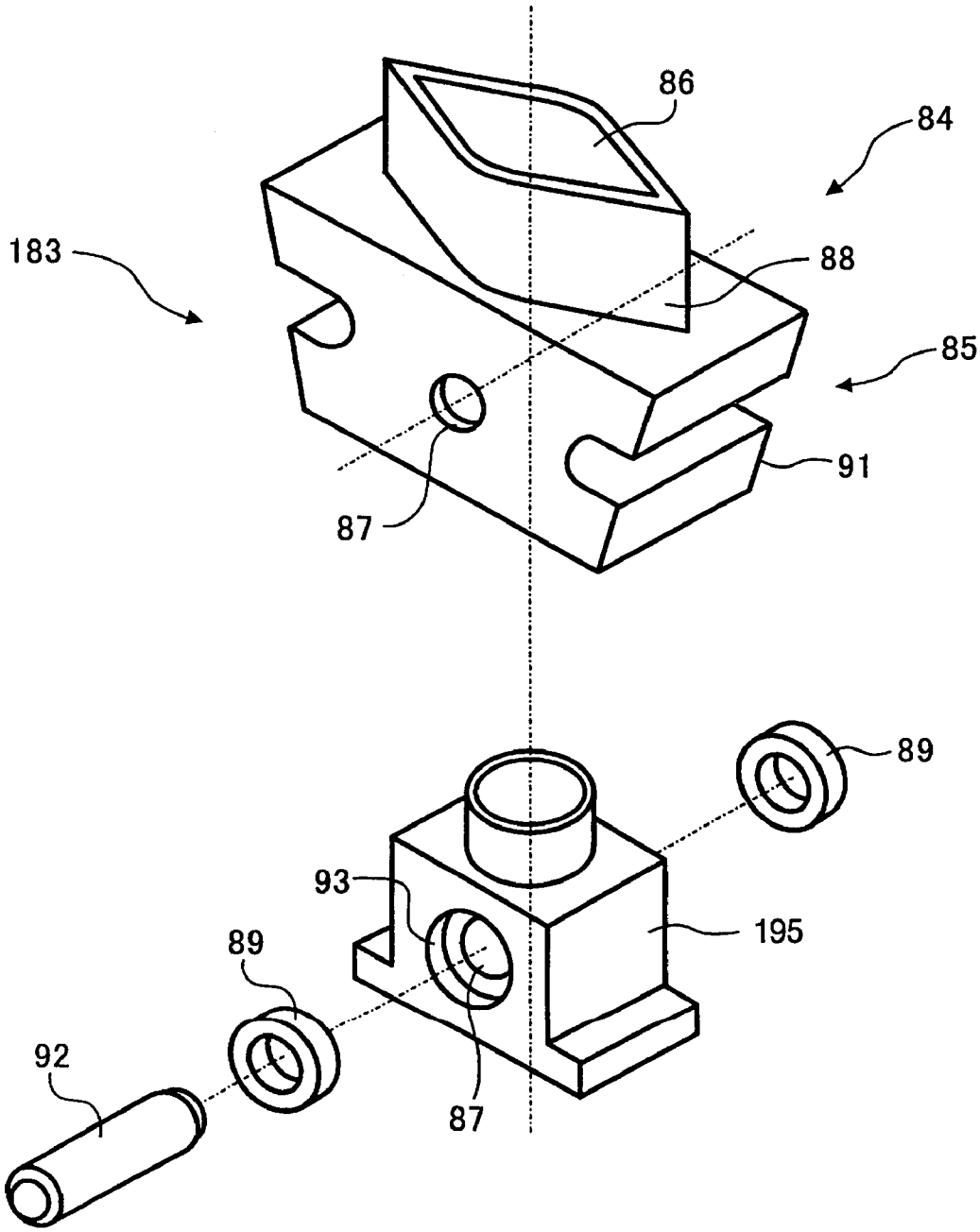
FIG. 13 is a schematic diagram showing a toner discharging unit which includes an upper main body and a lower main body.
Figure 14:
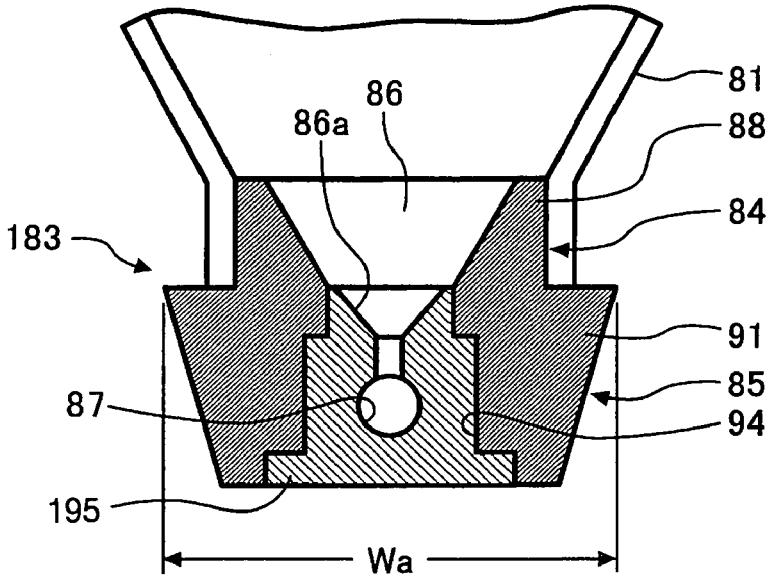
FIG. 14 is another diagram showing the toner discharging unit which includes the upper main body and lower main body.
Figure 15:
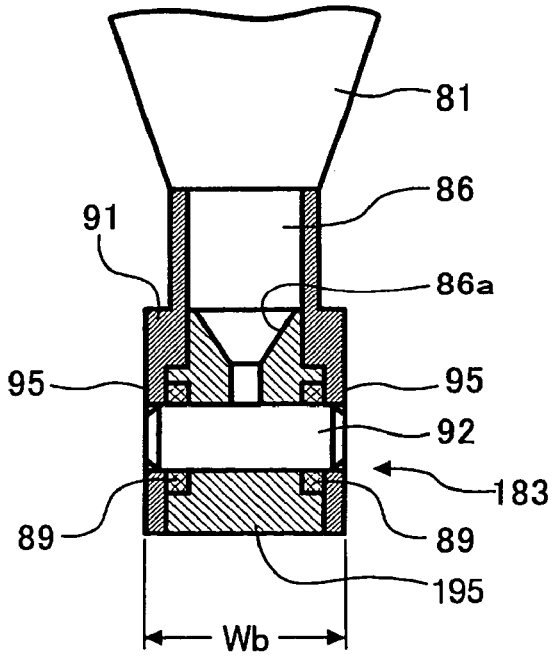
FIG. 15 is yet another diagram showing the toner discharging unit which includes the upper main body and lower main body.
Figure 21:
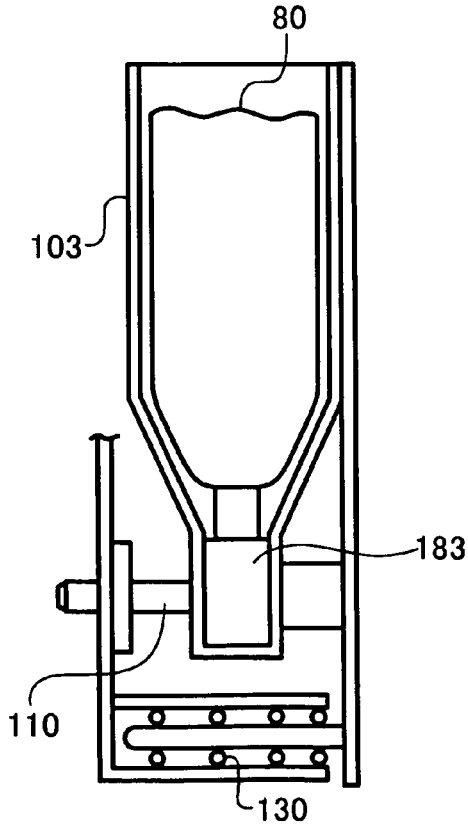
FIG. 21 is a diagram showing another exemplary enclosure.

As shown in FIGS. 13 to 15, the toner discharging unit 183 includes an upper main body 84 and an lower main body 85. The upper main body 84 is provided with a container fixing unit 88 which welds the toner sack 81 configured like a boat seen from the top. The lower main body 85 is of generally substantially rectangular shape. In the lower main body 85, when the left side as shown in FIG. 21 is the front side, the lower main body 85 of the toner discharging unit 183 has a front and back side width Wa wider than both side width Wb. The toner discharging unit 183 is made of resin such as polyethylene, nylon, or the like. The upper main body 84 is formed integral with the lower main body 85.

The toner discharging unit 183 includes two holes for discharging toner therethrough. One is an internal hole 86 of the toner sack 81. The other is a shutter hole 87 for communicating with the internal hole 86 and removalby inserting a shutter which is described later. The hole 86 is a longitudinal hole extending in a vertical direction with the toner discharging unit 183 facing downward. The shutter hole 87 is a transverse hole with an axis line generally perpendicular to an axis line of the internal hole 86. In this example, the shutter hole 87 is a penetrating hole of a circular cross-section through the front side of the lower main body 85 to the back side. The internal hole 86 is a circular cross-sectional hole having the shorter length in diameter inside a boat-shaped container fixing unit 88 with a funnel-shaped constraint 86*a* formed therebetween. That is, the internal hole 86 becomes small by the constraint 86*a* as it approaches the shutter hole 87 to communicate with an upper portion of the shutter hole 87. Therefore, the internal hole 86 has a smaller aperture than the shutter hole 87 in the communication between the internal hole 86 and the shutter hole 87. When a shutter 92 is inserted in the shutter hole 87, the hole for discharging the toner is securely closed.

In this embodiment, the shutter 92 has an axially circular cross-section with a slightly smaller diameter than the shutter hole 87. This allows the shutter 92 to be securely inserted in the shutter hole 87. However, when the shutter 92 has a smaller diameter than the shutter hole 87, toner and air are leaked between the shutter 92 and the shutter hole 87. The toner leakage causes toner contamination while the air leakage causes the toner container 80 to be reduced in volume. In order to avoid such a problem, O-rings 89 are provided with the toner discharging unit 183 to seal between the shutter hole 87 and the shutter 92. Since the shutter hole 87 is a penetrating hole, the O-rings 89 are provided on both sides of the shutter hole 87. Moreover, providing the O-rings 89 on both sides of the shutter hole 87 require grooves for attachment with adhesion or the like, causing labor intensive for securing the O-rings 89 and a high assembly cost.

Accordingly, the toner discharging unit 183 according to an embodiment shown in FIGS. 13 to 15 is divided into an inner component 195 and an outer component 91, both components supporting the O-rings 89. Specifically, the inner component 195 has an engagement groove 93 for engaging the O-rings 89. The outer component 91 is provided with an attachment 94 for attaching the inner component 195, the container fixing unit 88, a retainer 95 for retaining the O-rings 89 engaged by the engagement groove 93. When the O-rings 89 are engaged within the engagement groove 93 to attach the inner component 195 to the outer component 91, they are retained by the retainer 95 to thereby prevent the O-rings 89 from slipping out.

The shutter hole 87 is provided across the inner component 195 and the outer component 91 to attach the inner component 195 to the attachment 94 of the outer component 91 and to insert the shutter 92 into the shutter hole 87 so that the inner component 195 is assembled into the outer component 91. Further, easy operation of extracting the shutter 92 enables the toner discharging unit 183 to be divided into the inner component 195 and the outer component 91. Therefore, when the shutter 92 is moved widely or extracted with toner container 80 filled with toner, toner is prone to overflow from it so that the shutter 92 provides a diameter of 8 mm at maximum, preferably, 6 mm to avoid moving the shutter 92 with a finger. That is, when the shutter 92 has a diameter of 10 mm, toner frequently leaks with a finger moving the shutter 92 so that the shutter 92 is set within a 8 mm diameter.

On the other hand, as shown in FIGS. 9 and 11, the development unit 60 for replenishing toner is provided with a sub-hopper 61 for storing toner on the top thereof. The toner discharged from the toner container 80 is temporarily stored in the sub-hopper 61. The sub-hopper 61 is provided with a powder pump 70 on the top thereof. The powder pump 70 transports the toner discharged from the toner container 80 to the sub-hopper 61. The powder pump 70 is a pump having a single eccentric screw. The powder pump 70 includes a rotor 71, a stator 72, and a holder 73. The rotor 71 is made of rigid metal and formed in an eccentric screw shape. The stator 72 is made of elastic material such as a rubber and internally has spiral grooves in a two-screw shape. The holder 73 stores the rotor 71 and the stator 72, and is made of the plastic material same as that used for the passage for transporting the toner. The rotor 71 is stored inside the stator 72 and is connected with a driving gear 74 using a pin connector so that the rotor 71 can be driven for rotation by the driving gear 74 and, as a result, the toner inside the stator 72 is transported to the sub-hopper 61 by an action of a negative pressure generated by the rotation of the rotor 71 in the powder pump 70. A gear 75 (see FIG. 9) integrally formed with the driving gear 74 is connected with a first clutch 76 via an idle gear (not shown). By switching the first clutch 76 between connection and disconnection, the operation of the powder pump 70 is controlled. The first clutch 76 and a second clutch 68 (later explained) are provided to a rotation driving shaft 79, which is driven by a driving mechanism (not shown).

The holder 73 includes a toner sucking portion 77 at an end thereof, a right end of the holder 73 in FIG. 11, to which the above-mentioned toner transportation tube 78 is connected. The toner transportation tube 78 preferably is a flexible tube having a diameter of from 4 mm to 10 mm, for example, and is made of a rubber material having a superior anti-toner characteristic, such as polyurethane, nitrile, EPDM (ethylene-propylene-diene-methylene), silicon, or the like. Such toner transportation tube 78 can be bent easily and arbitrarily in any direction.

FIG. 10 is a top view of the upper chamber 62 and FIG. 11 is a tope view of the lower chamber 63. The sub-hopper 61 is divided into an upper chamber 62 and a lower chamber 63. The upper chamber 62 has a larger floor area than the lower chamber 63 and is provided with a pair of upper screws 64 and 65 and a partition 66 having two cut ends, left and right cut ends in FIG. 10, where the partition 66 is positioned between the pair of upper screws 64 and 65 and the two cut ends are shorter than an internal width of the upper chamber 62. In FIG. 10, a position A in the upper chamber 62 indicated by a circular mark with a partly-dotted line is a position to which the toner transported by the powder pump 70 is supplied. The toner supplied at the position A is transported within the upper chamber 62 in a direction P1 by the rotations of the upper screws 64 and 65. An opening B in the upper chamber 62 indicated by a square mark with a solid line is an opening connecting inside spaces of the upper chamber 62 and the lower chamber 63.

Figure 16:
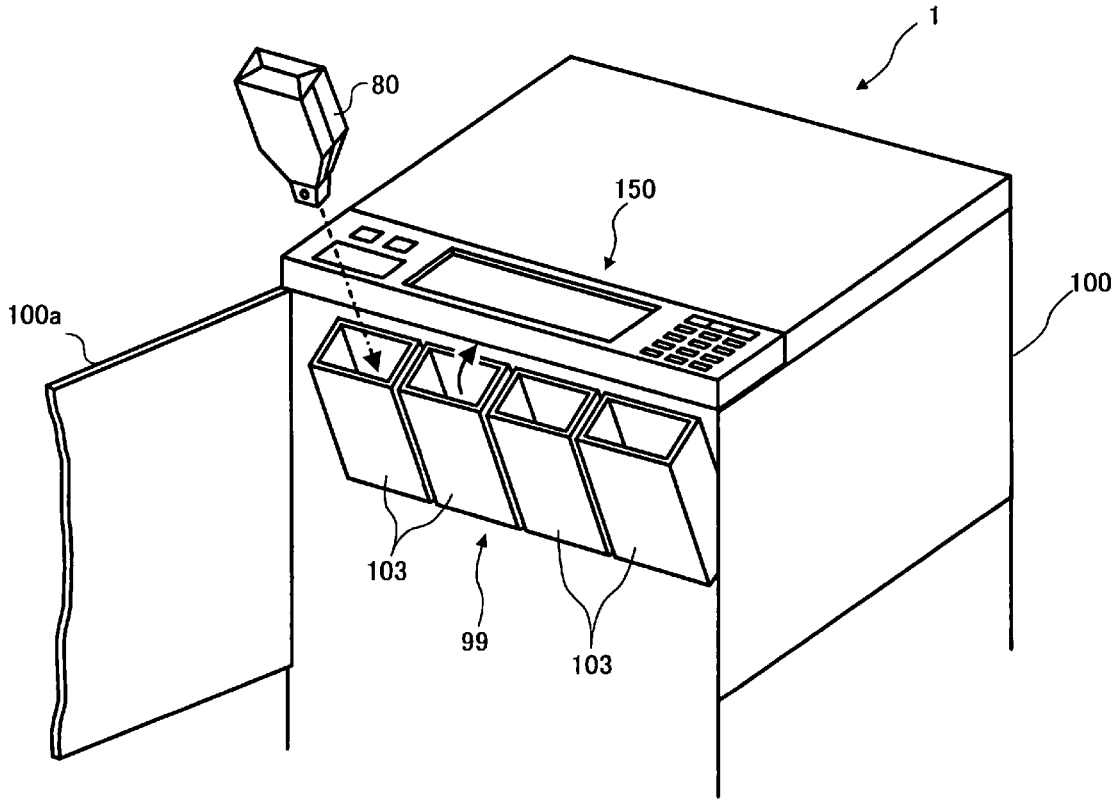
FIG. 16 is a schematic diagram showing an image forming apparatus which includes an enclosure to which the toner container having four toner folders is attached.

As shown in FIG. 16, the image forming apparatus includes the enclosure 99 to which the toner container 80 having four toner folders for four colors is attached. The enclosure 99 with four folders has a substantially identical internal structure for each folder except that one folder having the toner container 80 for black is widen.

Figure 17:
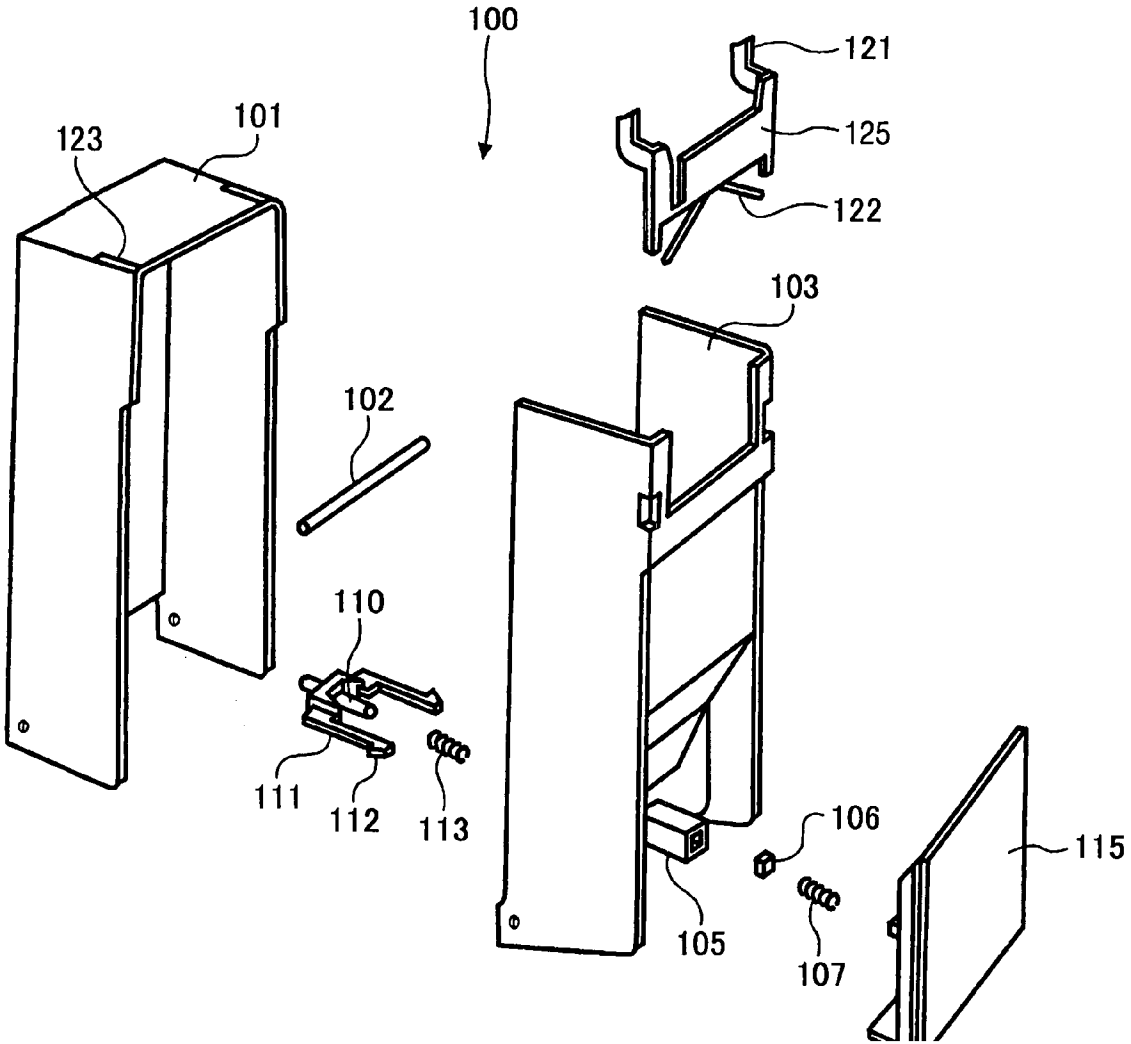
FIG. 17 is a diagram showing an open and close folder of the enclosure.
Figure 18:
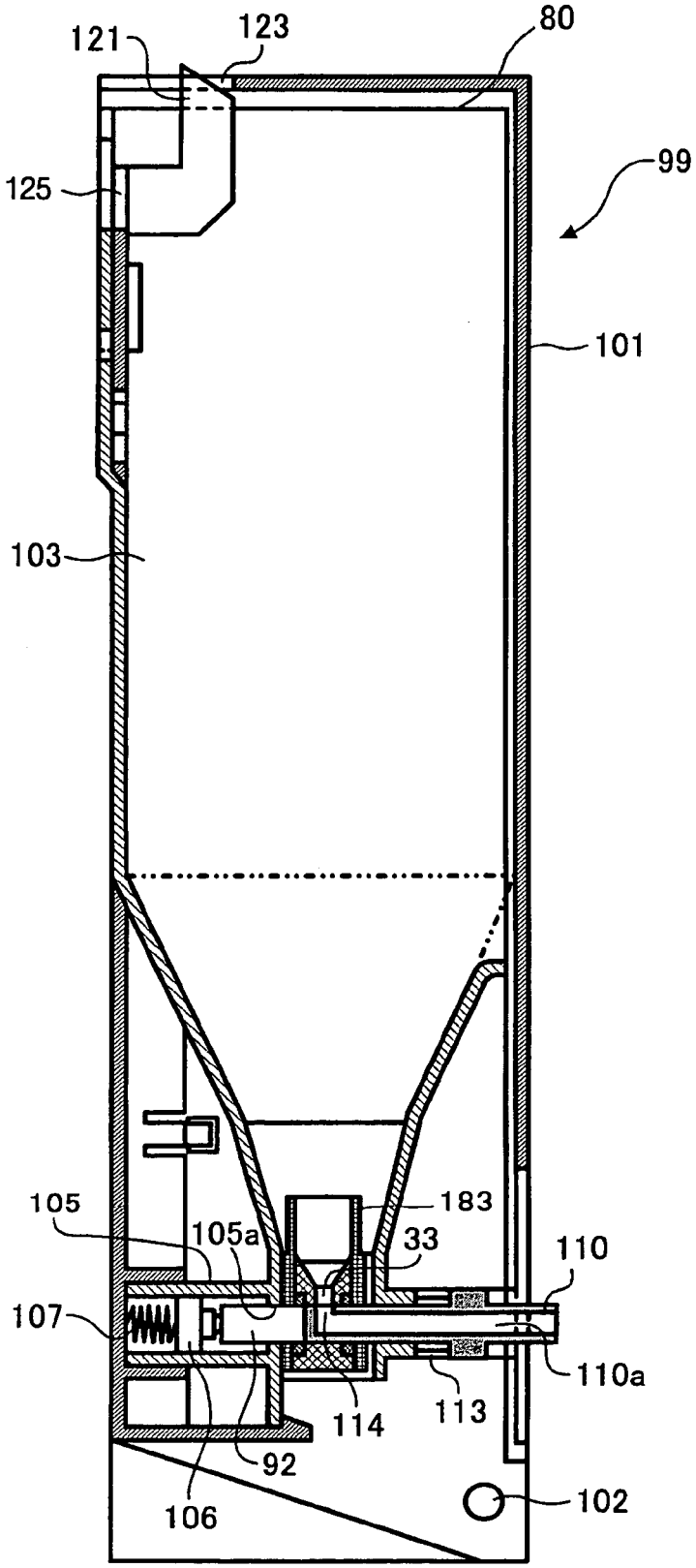
FIG. 18 is a diagram showing the enclosure which includes the open and close folder which has the separated toner container.

As shown in FIGS. 17 and 18, the enclosure 99 includes an open and close folder 103 which has the separated toner container 80 for each color and is attached to a body frame 101 with a rotation shaft 102. The open and close folder 103 is pivotally mounted with respect to the body frame 101 between a closed position shown in FIG. 18 and a tilt position shown in FIG. 19. The open and close folder 103 is provided with a pair of nozzle guide members (not shown) and a guide tube 105 at the bottom thereof. The nozzle guide members slideably support a nozzle 110. The guide tube 105 is slideably engaged with a slider 106 for returning the inserted nozzle 110. The open and close folder 103 is provided with a fixed cover 115 on an outside surface thereof. Further, the open and close folder 103 has an open and close handle 125 on the top thereof movably mounted in the vertical direction. The open and close handle 125 includes a stopper 121 for engaging the open and close folder 103 at the closed position when the open and close folder 103 can be lifted by manually to the closed position.

The handle 125 is made of resin and integrally forms a resilient arm 122 at the bottom thereof. The resilient arm 122 lifts the handle 125 to its uppermost position at all times. The nozzle 110 is of the same diameter as the shutter 92.

The nozzle 110 is provided with a slide arm 111 integrally formed at both sides thereof, the slide arm 111 being movably mounted to the nozzle guide members. The slide arm 111 includes a pawl 112 on an end thereof and the pawl 112 is engaged with an end of the nozzle guide members, thus preventing the nozzle 110 from pulling out of the folder 103. Arranged between the nozzle 110 and the folder 103 is an compression spring 113 which fits loosely to wrap around the nozzle 110. The spring 113 holds the nozzle 110 with spring effect at a position where the pawl 112 is engaged with an end of the nozzle guide members at all times.

The guide tube 105 expands axially toward the nozzle 110 to form a hole 105*a* into which the shutter 92 can be inserted at one end opposite the nozzle 110. The other end of the nozzle 110 is sealed by the fixed cover 115. The guide tube 105 encloses the slider 106 and a compression spring 107, the compression spring 107 pushing the slider 106 to the nozzle 110. The slider 106 has a cross section in a convex form and is held in the guide tube 105 even when the slider 106 is pushed to the compression spring 107 by a detent 108 which is formed at the nozzle side of the guide tube 105. The open and close folder 103 is provided with a guide frame 109 for placing the inserted toner container 80 in the set position. The guide frame 109 has a bottom portion where the nozzle 110 is provided so as to form a holder for holding a bottom body 85 of a toner discharging unit 183 of the toner container 80. The holder includes an opening (not shown) through which the nozzle 110 and the shutter 92 pass.

Figure 19:
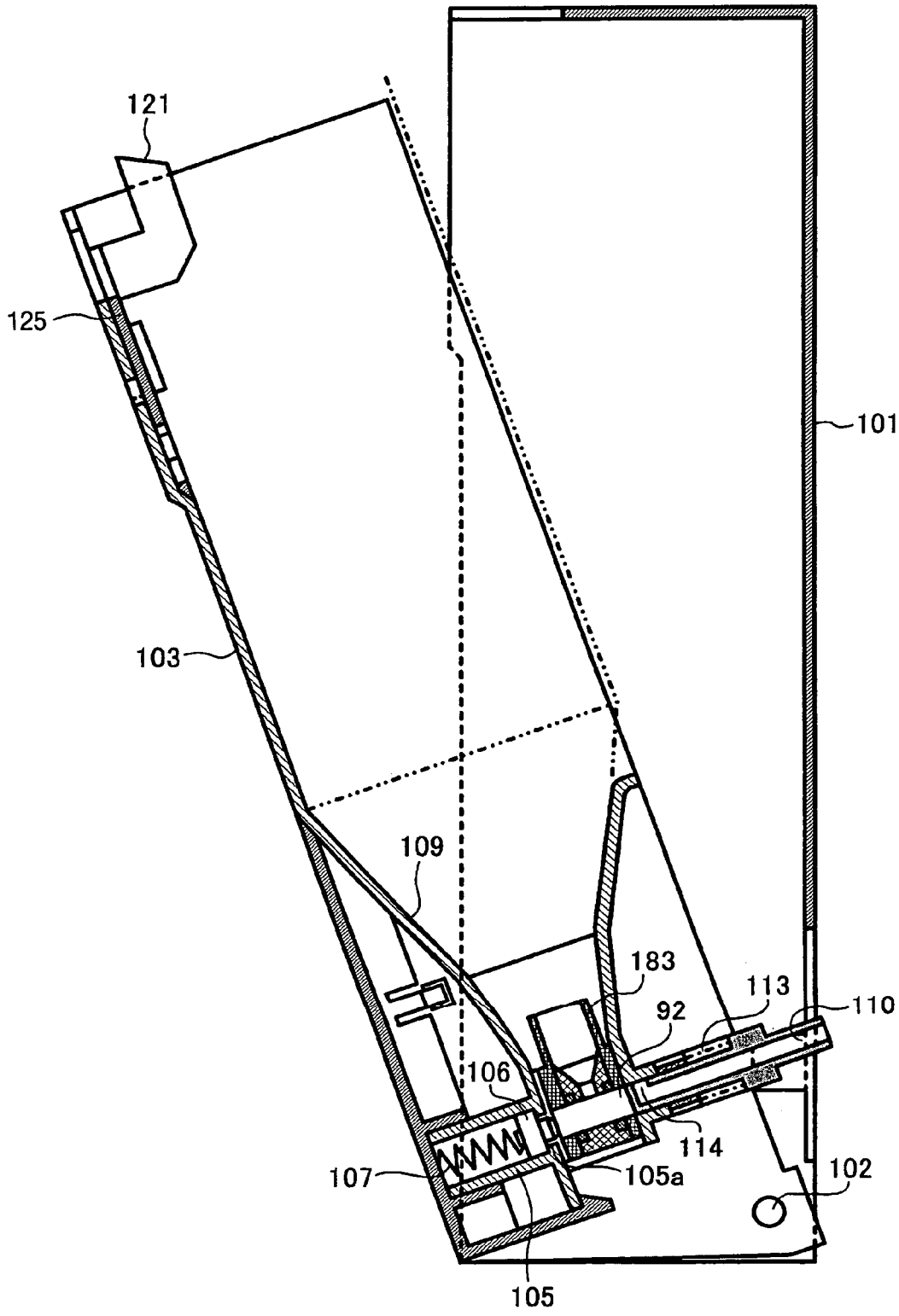
FIG. 19 is a diagram showing the enclosure which is pulled out with the handle.

When the thus-structured enclosure 99 is pulled out with the handle 125 positioning downward, the stopper 121 disengages from an engagement groove 123 of the body frame 101 to pivot the open and close folder 103 about the rotation shaft 102 to the position where the bottom of the folder 103 contacts with the frame 101 as shown in FIG. 19. The folder 103 then moves to a tilt position, where the nozzle 110 is retracted inward as shown on the left hand side of FIG. 18. At this position, the toner container 80 is pushed with the toner discharging unit 183 downward so that the shutter 92 of the toner discharging unit 183 is lowered to a position opposed to the nozzle 110 which is held at the position where the pawl 112 contacts with the nozzle guide members by the compression spring 113.

After the toner container 80 is inserted in a predetermined position, the open and close folder 103 is returned to a closed position shown in FIG. 18. This operation causes the nozzle 110 to be inserted in the shutter hole 87 and the shutter 92 moves from the hole 105*a* to the guide tube 105. The nozzle 110 includes a toner inlet 114 on a circumference surface near its end. The toner inlet 114 communicates with the lower portion of an inner hole 33 provided to the toner discharging unit 183 so that a path for transporting the toner from the toner container 80 to the development mechanism 60 is opened. The shutter 92 pushed toward the guide tube 105 by an insertion of the nozzle 110 is hold in a position across the shutter hole 87 and the guide tube 105 without completely pulling out of the shutter hole 87.

When the nozzle 110 is inserted into the shutter hole 87, the compression spring 113 is compressed against the open and close folder 103. Further, the compression spring 107 provided in the guide tube 105 is also compressed by the insertion of the shutter 92 through the slider 106. Thus, when the folder 103 is moved from the closed position to the tilt position, the nozzle 110 returns to its original position with a force of the compression spring 113 and the shutter 92 also returns to its original position with a force of the compression spring 107. Therefore, the nozzle 110 pulls out of the shutter hole 87 of the toner container 80 and then the shutter 92 is again inserted into the shutter hole 87.

Figure 20:
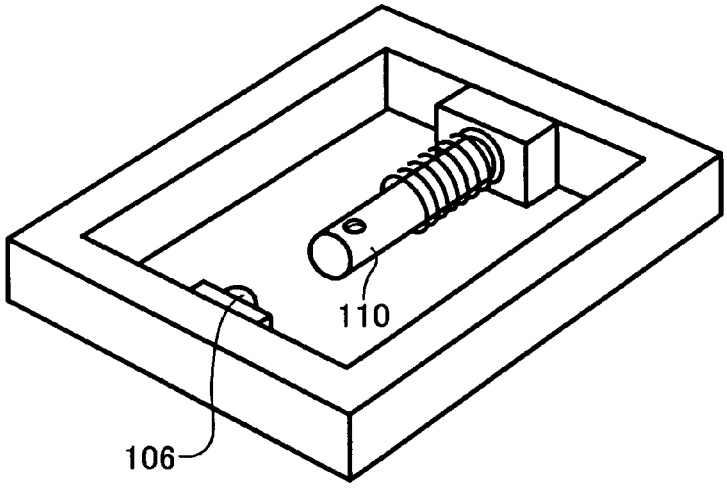
FIG. 20 is a diagram showing a nozzle and a slider.

As previously described, by simply setting the toner container 80 to the color copying apparatus 1, the container 80 communicates with a toner replenishment path. When the open and close folder 103 is opened, the nozzle 110 pulls out of the shutter hole 87 and then the shutter 92 immediately returns so that a toner does not leak from the toner container 80. In this embodiment, since the nozzle 110 and the slider 106 move by the same amount toward the same direction at the time of a setup of the toner container 80, the nozzle 110 and the slider 106 may be integrated as shown in FIG. 20. This structure eliminates the problems such that the slier 106 does not move even if the nozzle 110 pulls out and the shutter 92 does not seal the shutter hole 87.

Figure 22:
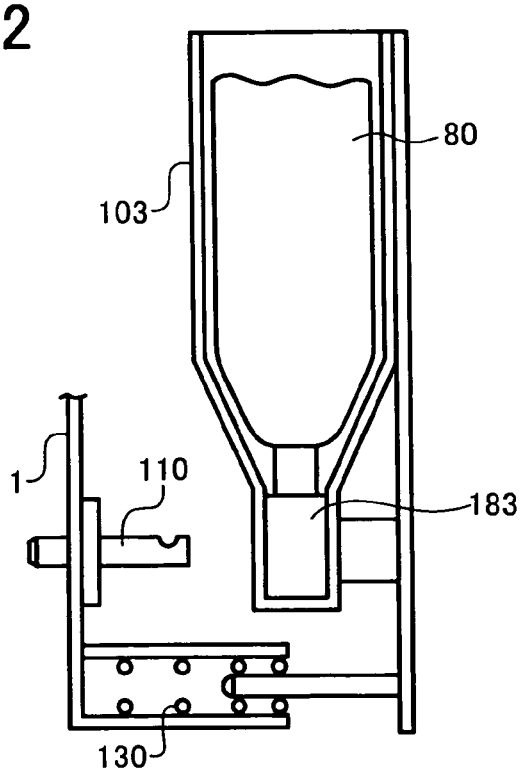
FIG. 22 is another diagram showing the enclosure shown in FIG. 21.

FIGS. 21 and 22 show another example of an enclosure. In this example, the open and close folder 103 slideably moves in the directions of arrows by a linear guide 130 so that the folder 103 is slideably opened and closed to the color copying apparatus 1.

The open and close folder 103 is attached to the apparatus 1 via the linear guide 130. As shown in FIG. 22, at the same time that the folder 103 is drawn from the apparatus 1, the nozzle 110 moves away from the toner discharging unit 183 so that the toner container 80 can be removed. At this time, when the container 80 is replaced with new one and the open and close folder 103 is inserted into the apparatus 1, the nozzle 110 is set into the toner discharging unit 183 to replenish toner into the development mechanism.

Figure 23:
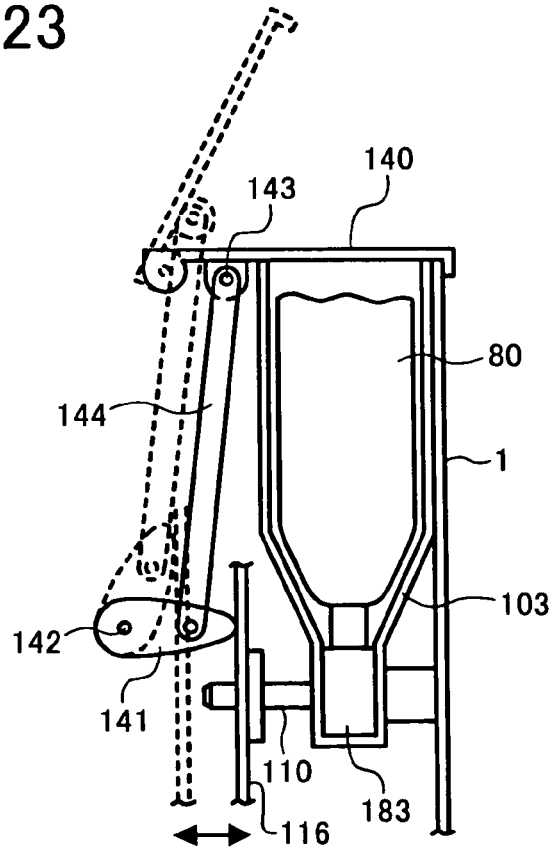
FIG. 23 is a diagram showing yet another exemplary enclosure.

FIG. 23 shows another example of an enclosure. In this example, the open and close folder 103 is immovable relative to the color copying apparatus 1. In addition, to insert and remove the toner container 80, a door 140 is provided on the folder 103. A nozzle support member 116 for supporting the nozzle 110 is supported by the liner guide (not shown) in the directions of arrows to permit horizontal movement. The nozzle support member 116 is moved in the directions of the arrows by a cam 141 which pivots around a fulcurum 142. The door 140 pivots around a fulcurum 143.

Configured in this manner, the cam 141 connects the door 140 by an arm 144 as shown in FIG. 23. so that the cam 141 rotates in combination with an open and close of the door 140 to insert and remove the nozzle 110. Therefore, opening the door 140 moves the nozzle 110 away from the toner discharging unit 183 to allow for a replacement and removal of the toner container 80. Closing the door 140 inserts the nozzle 110 into the toner discharging unit 183 via the arm 144, the cam 141 and the nozzle supporting member 116 to allow for toner absorption and replenishment.

Figure 24:
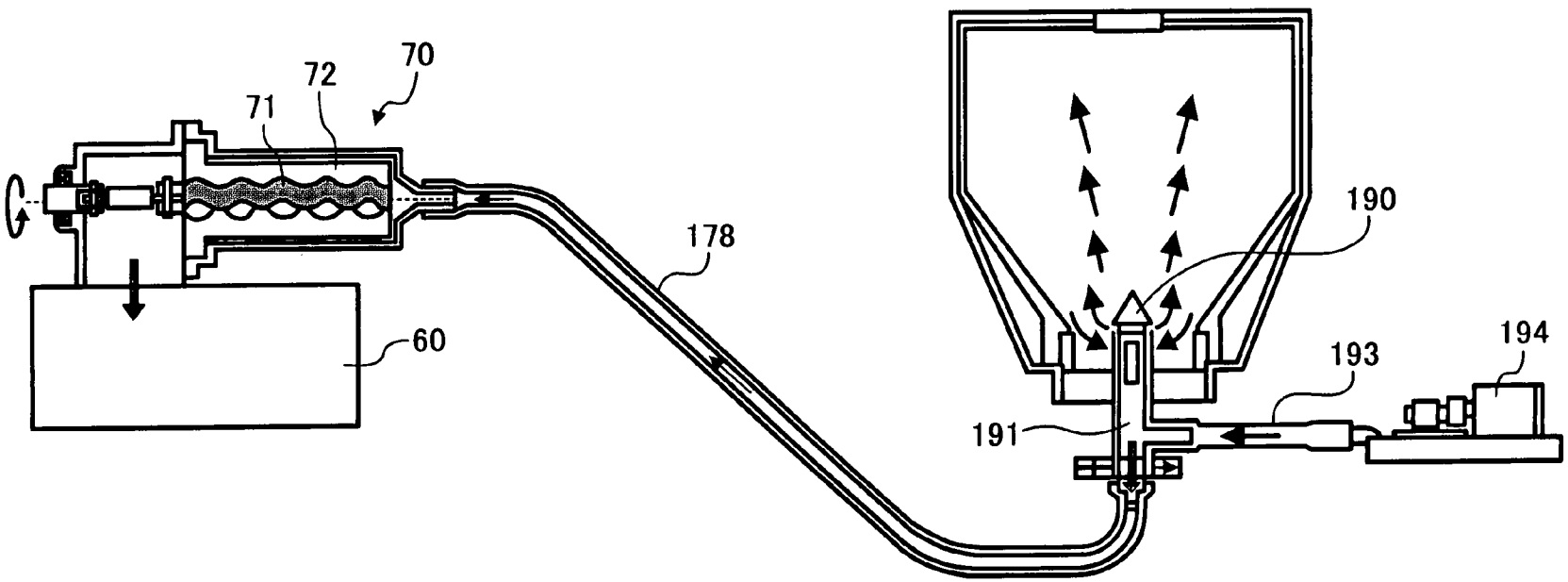
FIG. 24 is a diagram showing another exemplary toner replenishing mechanism.

Referring now to FIG. 24, another example of a toner replenishing mechanism will be described. In FIG. 24, a toner replenishing mechanism utilizes the powder pump 70, which is similar to the embodiment described above, located to near the development unit 60 as a screw pump mechanism. The enclosure 99 of an image forming apparatus body is provided with a nozzle 190 which is inserted into the toner sack 81. The nozzle 190 has a circular cross section. The toner container 80 is inserted upwardly into the enclosure of the apparatus body to insert the nozzle 190 into a toner discharging unit. The nozzle 190 of the enclosure includes a tubular structure having a passage 191 which is connected to a toner transportation tube 178 at the end thereof. The passage 191 is bent to the right of the drawing above the toner transportation tube 178 to connect to an air pump 194 via an air transportation tube 193.

When the air pump 194 is in operation, it discharges the air in a confined jet to inside the toner container 80 from the bottom via the air transportation pipe 193. The jet air entered inside the toner container 80 agitates the toner and fluidizes the toner in the toner container 80. When the powder pump 70 is in operation, it absorbs the toner and the air in the toner container 80 to replenish the toner into the development unit 60.

Numerous additional modifications and variations are possible in light of the above teachings. It is therefore to be understood that within the scope of the appended claims, the disclosure of this patent specification may be practiced otherwise than as specifically described herein.

What is claimed as new and desired to be protected by Letters Patent of the United States is:

1. An image forming apparatus comprising:

a development mechanism configured to develop an electrostatic latent image formed on an image carrying member into a visual image;

a toner storage detachably installed and configured to store toner therein;

a toner transporting mechanism configured to transport the toner from the toner storage to the development mechanism; and a supporting device configured to detachably support the toner storage therein and to move between a set position at which the toner storage is engaged with the toner transporting mechanism and a tilt position at which the toner storage is disengaged from the toner transporting mechanism, the set position of the supporting device being located underneath a control panel of the apparatus and in front of the apparatus.

2. The image forming apparatus as defined in claim 1, wherein the supporting device at the tilt position extends out such that at least a portion of the toner storage supported by the supporting device projects from an outside surface of the apparatus.

3. The image forming apparatus as defined in claim 1, further comprising a nozzle for transporting the toner, wherein the toner storage comprises a sack for containing toner and a ring portion having a toner discharging unit at a bottom portion of the sack, and the toner transporting mechanism transports the toner in the toner storage to the development mechanism when the nozzle is connected to the ring portion.

4. The image forming apparatus as defined in claim 3, wherein the nozzle connects to and disconnects from the ring portion when the toner storage is inserted into and extracted from the supporting device.

5. The image forming apparatus as defined in claim 3, wherein the nozzle is inserted into and extracted from the ring portion when the supporting device moves between the set position and the tilt position.

6. The image forming apparatus as defined in claim 5, wherein the toner storage includes a shutter configured to close the toner discharging unit of the toner storage and the shutter replaces the nozzle and moves between a closed position and an opened position of the toner discharging unit.

7. The image forming apparatus as defined in claim 6, wherein the supporting device comprises an interlocking mechanism configured to move between the closed position and the opened position of the shutter in conjunction with insertion and extraction of the nozzle.

8. An image forming apparatus comprising:

a development mechanism configured to develop an electrostatic latent image formed on an image carrying member into a visual image;

a toner storage detachably installed and configured to store toner;

a toner transporting mechanism configured to transport the toner from the toner storage to the development mechanism; and a supporting device configured to detachably support the toner storage and to move between a set position at which the toner storage is engaged with the toner transporting mechanism and a projecting position at which the toner storage is disengaged from the toner transporting mechanism, the set position of the supporting device located underneath a control panel of the apparatus and in front of the apparatus.

* * * * *